US008805256B2

(12) United States Patent
Shirai

(10) Patent No.: US 8,805,256 B2
(45) Date of Patent: Aug. 12, 2014

(54) PRINTING APPARATUS CAPABLE OF PREVENTING SHEET FEED ERROR IN CLEANING, METHOD OF CONTROLLING THE PRINTING APPARATUS, AND STORAGE MEDIUM

(75) Inventor: Toshiaki Shirai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 13/351,445

(22) Filed: Jan. 17, 2012

(65) Prior Publication Data

US 2012/0189360 A1 Jul. 26, 2012

(30) Foreign Application Priority Data

Jan. 24, 2011 (JP) ..... 2011-012240

(51) Int. Cl.
*G03G 15/20* (2006.01)

(52) U.S. Cl.
USPC ..... 399/327

(58) Field of Classification Search
USPC ..... 399/326, 327
See application file for complete search history.

(56) References Cited

U.S. PATENT DOCUMENTS 6,094,559 A 7/2000 Otsuka et al.
8,218,160 B2 * 7/2012 Ferlitsch ..... 358/1.13
2007/0291286 A1 12/2007 Utsunomiya et al.
2008/0175614 A1 * 7/2008 Miyazaki ..... 399/68
2008/0180711 A1 * 7/2008 Ebuchi ..... 358/1.12

FOREIGN PATENT DOCUMENTS

CN 1210286 A 3/1999
JP 8-328421 A 12/1996
JP 2001-22216 A 1/2001

OTHER PUBLICATIONS

Translation of Takahiro (JP,08-328421, A: pub date: Dec. 13, 1996).*
Translation of Canon (JP 2001-022216,A: pub date: Jan. 26, 2001).*
Official Action mailed Mar. 14, 2013, in Russian Application No. 2012102250/28.
Office Action dated Mar. 27, 2014, in Chinese Patent Application No. 201210020600.5.

* cited by examiner

*Primary Examiner* — Walter L Lindsay, Jr.
*Assistant Examiner* — Frederick Wenderoth
(74) *Attorney, Agent, or Firm* — Fitzpatrick, Cella, Harper & Scinto

(57) ABSTRACT

A printing apparatus which is capable of preventing printing from being performed on a sheet different from a sheet originally intended for printing, after completion of cleaning. The printing apparatus has a fixing device for fixing an image recorded on a sheet fed from a sheet feeder. The printing apparatus feeds a sheet from the sheet feeder and performs cleaning of the fixing device using the fed sheet. After execution of the cleaning of the fixing device, the printing apparatus requests a user to set a sheet to be used for a page to be printed next, in the sheet feeder.

17 Claims, 21 Drawing Sheets

PRINTING APPARATUS CAPABLE OF PREVENTING SHEET FEED ERROR IN CLEANING, METHOD OF CONTROLLING THE PRINTING APPARATUS, AND STORAGE MEDIUM

BACKGROUND OF THE INVENTION

1. Field of the Invention

The present invention relates to a printing apparatus, a method of controlling the same, and a storage medium.

2. Description of the Related Art

In a conventional printing apparatus, an unfixed toner image transferred onto a sheet is fixed by a fixing device including a rotatable heating roller and a rotatable pressure roller. In the fixing device, the sheet is heated and pressed while causing the nip formed by the pressure roller in pressure contact with the heating roller to sandwich and convey therethrough the sheet having the unfixed toner image formed thereon, whereby the toner image is fixed on the sheet. As can be understood from the above-described operation, it is desirable that the fixing device is configured to heat and melt the whole of an unfixed toner image transferred on a sheet and then fix the same on the sheet.

However, when half melted toner, overmelted toner, toner having electrostatically adhered to the heating roller, or the like exists, the toner is transferred as toner soil to the pressure roller via the heating roller. Then, when toner soil is accumulated on the pressure roller, a sheet easily sticks to the pressure roller, so that a sheet can be wound around the pressure roller, or a sheet can be soiled by the accumulated toner soil.

To solve this problem, there has been proposed a method in which a cleaning sheet is passed through a fixing device so as to remove toner soil from a pressure roller (see e.g. Japanese Patent Laid-Open Publication No. 2001-22216).

Japanese Patent Laid-Open Publication No. 2001-22216 discloses two cleaning methods.

In the first cleaning method, a cleaning sheet having a solid black image printed on one side thereof is passed through a nip formed between a heating roller and a pressure roller, in a state where the surface printed with the solid black image faces the pressure roller. This makes it possible to cause toner soil on the pressure roller to adhere onto the cleaning sheet, whereby it is possible to remove the toner soil from the pressure roller. This method utilizes differences in adhesion of toner soil remaining half melted on the pressure roller to the sheet, the pressure roller, and the solid black image.

In the second cleaning method, when a cleaning sheet is nipped by a nip, rotation of the heating roller and the pressure roller is stopped, and the nip is heated. Then, the heating is stopped after soil on the pressure roller held in pressure contact with the heating roller via the cleaning sheet is fully melted, and then after the sheet in the nip and the pressure roller are cooled as appropriate, the heating roller and the pressure roller are rotated to bring a next cleaning portion of the pressure roller to the nip. This sequence of operations is performed as one step, and the same step is repeatedly carried out, whereby it is possible to remove toner soil from the pressure roller.

It is desirable that a cleaning sheet for use in the above-described cleaning method has a width close to that of the pressure roller or the heating roller so as to remove toner soil from the pressure roller or the heating roller. For this reason, the user sets a sheet having the width close to the pressure roller in a sheet feeder of the printing apparatus before cleaning. This makes it possible to minimize the amount of toner soil on the pressure roller left unremoved by the toner soil removal operation.

Japanese Patent Laid-Open Publication No. H08-328421 discloses an image forming apparatus which prompts the user to set a cleaning sheet when a toner remaining amount becomes equal to or smaller than a predetermined amount or after a paper jam has been detected, and then automatically cleans a fixing device by feeding the set cleaning paper. According to this apparatus, it is possible to automatically perform cleaning without receiving a cleaning instruction manually given by the user.

However, in a job for executing next printing after completion of cleaning operation using a cleaning sheet, printing is not always performed on a sheet having the same size as that of the cleaning sheet. For example, there is a case where the size of a sheet that can be used for cleaning is A4, and the size of a sheet to be used for printing after the cleaning is A5. In this case, if the printing apparatus executes the next print job immediately after completion of the cleaning, there is a fear that the sheet having a size not intended by the user might be fed for printing.

SUMMARY OF THE INVENTION

The present invention provides a printing apparatus which is capable of preventing printing from being performed on a sheet different from a sheet on which printing should be performed, after completion of cleaning, a method of controlling the printing apparatus, and a storage medium.

In a first aspect of the present invention, there is provided a printing apparatus having a fixing device for fixing an image recorded on a sheet fed from a sheet holding unit, comprising a control unit configured to feed a sheet from the sheet holding unit and perform cleaning of the fixing device using the fed sheet, and a request unit configured to be operable after execution of the cleaning of the fixing device by the control unit, to request a user to set a sheet to be used for a page to be printed next, in the sheet holding unit.

In a second aspect of the present invention, there is provided a printing apparatus having a fixing device for fixing an image recorded on a sheet fed from a sheet holding unit, comprising a control unit configured to feed a sheet from the sheet holding unit and perform cleaning of the fixing device using the fed sheet, and a suspension unit configured to be operable after execution of the cleaning of the fixing device by the control unit, to perform control such that printing is disabled until a user instruction is received, even if there is a page to be printed.

In a third aspect of the present invention, there is provided a printing apparatus having a fixing device for fixing an image recorded on a sheet fed from a sheet holding unit, comprising a request unit configured to request a user to perform cleaning of the fixing device, when a first condition is satisfied, a receiving unit configured to receive from the user an instruction as to whether or not to perform the cleaning of the fixing device according to the request from the request unit, and a restriction unit configured to restrict printing, when the receiving unit receives an instruction not to perform the cleaning from the user and a second condition is satisfied without executing the cleaning.

In a fourth aspect of the present invention, there is provided a method of controlling a printing apparatus having a fixing device for fixing an image recorded on a sheet fed from a sheet holding unit, comprising feeding a sheet from the sheet holding unit and performing cleaning of the fixing device using the fed sheet, and requesting, after execution of the cleaning of the fixing device, a user to set a sheet to be used for a page to be printed next, in the sheet holding unit.

In a fifth aspect of the present invention, there is provided a method of controlling a printing apparatus having a fixing device for fixing an image recorded on a sheet fed from a sheet holding unit, comprising feeding a sheet from the sheet holding unit and performing cleaning of the fixing device using the fed sheet, and performing control, after execution of the cleaning of the fixing device, such that printing is disabled until a user instruction is received, even if there is a page to be printed.

In a sixth aspect of the present invention, there is provided a method of controlling a printing apparatus having a fixing device for fixing an image recorded on a sheet fed from a sheet holding unit, comprising requesting a user to perform cleaning of the fixing device, when a first condition is satisfied, receiving from the user an instruction as to whether or not to perform the cleaning of the fixing device according to the request, and restricting printing, when an instruction not to perform the cleaning is received from the user and a second condition is satisfied without executing the cleaning.

In a seventh aspect of the present invention, there is provided a non-transitory computer-readable storage medium storing a computer-executable program for causing a computer to execute a method of controlling a printing apparatus having a fixing device for fixing an image recorded on a sheet fed from a sheet holding unit, wherein the method comprises feeding a sheet from the sheet holding unit and performing cleaning of the fixing device using the fed sheet, and requesting, after execution of the cleaning of the fixing device, a user to set a sheet to be used for a page to be printed next, in the sheet holding unit.

In an eighth aspect of the present invention, there is provided a non-transitory computer-readable storage medium storing a computer-executable program for causing a computer to execute a method of controlling a printing apparatus having a fixing device for fixing an image recorded on a sheet fed from a sheet holding unit, wherein the method comprises feeding a sheet from the sheet holding unit and performing cleaning of the fixing device using the fed sheet, and performing control, after execution of the cleaning of the fixing device, such that printing is disabled until a user instruction is received, even if there is a page to be printed.

In a ninth aspect of the present invention, there is provided a non-transitory computer-readable storage medium storing a computer-executable program for causing a computer to execute a method of controlling a printing apparatus having a fixing device for fixing an image recorded on a sheet fed from a sheet holding unit, wherein the method comprises requesting a user to perform cleaning of the fixing device, when a first condition is satisfied, receiving from the user an instruction as to whether or not to perform the cleaning of the fixing device according to the request, and restricting printing, when an instruction not to perform the cleaning is received from the user and a second condition is satisfied without executing the cleaning.

According to the present invention, it is possible to prevent printing from being performed on a sheet different from a sheet on which printing should be performed, after completion of cleaning.

Further features of the present invention will become apparent from the following description of exemplary embodiments with reference to the attached drawings.

BRIEF DESCRIPTION OF THE DRAWINGS

FIGS. 11A to 11C are views illustrating examples of operation screens displayed on a console section of the printing apparatus, in which FIG. 11A illustrates a screen for notifying a user that the fixing device needs cleaning, FIG. 11B illustrates a screen for requesting the user to execute fixing device cleaning, and FIG. 11C illustrates a screen for requesting the user to check sheets for use in printing.

FIGS. 12A and 12B are views illustrating examples of operation screens displayed on a display section of the PC, in which FIG. 12A illustrates a default screen displayed when an application for operating the printing apparatus is started, and FIG. 12B illustrates a screen for notifying the user that the fixing device needs cleaning.

FIGS. 13A and 13B are views illustrating examples of operation screens displayed on the display section of the PC, in which FIG. 13A illustrates a screen for requesting the user to execute fixing device cleaning, and FIG. 13B illustrates a screen for requesting the user to check sheets for use in printing.

FIGS. 18A and 18B are views illustrating examples of operation screens displayed on a console section of the printing apparatus, in which FIG. 18A illustrates a screen displayed in steps of FIG. 16A, and FIG. 18B illustrates a screen displayed in a step of FIG. 17.

FIGS. 19A and 19B are views illustrating examples of operation screens displayed on a display section of a PC, in which FIG. 19A illustrates a screen displayed in steps of FIG. 16A, and FIG. 19B illustrates a screen displayed in a step of FIG. 17.

DESCRIPTION OF THE EMBODIMENTS

The present invention will now be described in detail below with reference to the accompanying drawings showing embodiments thereof.

Figure 1:
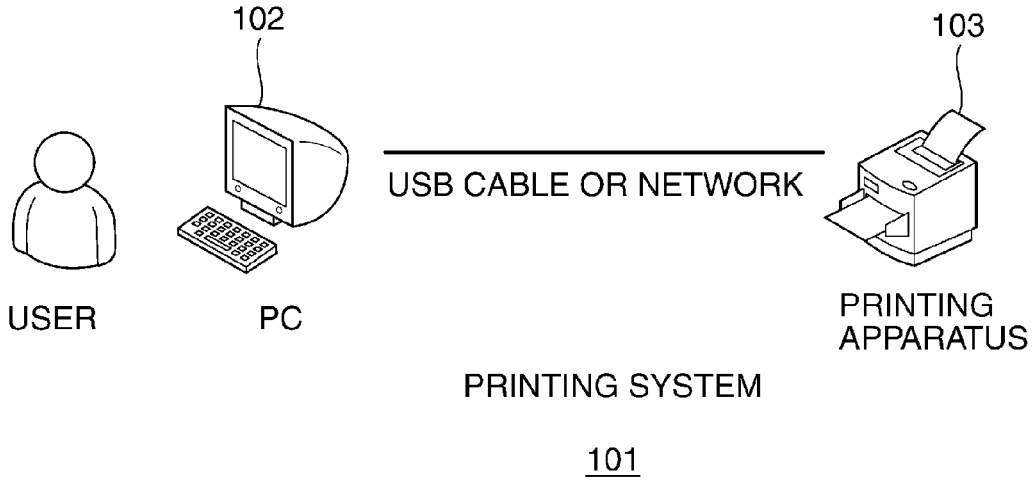
FIG. 1 is a diagram schematically showing a printing system including a printing apparatus according to a first embodiment of the present invention.

FIG. 1 is a diagram schematically showing a printing system including a printing apparatus according to a first embodiment of the present invention.

The printing system, denoted by reference numeral 101, comprises a personal computer (PC) 102 as an information processing apparatus, and the printing apparatus, denoted by reference numeral 103, according to the first embodiment. The PC 102 and the printing apparatus 103 are connected to each other by a USB cable or a network, such as a LAN.

The PC 102 generates a print job according to operation by a user and sends the print job to the printing apparatus 103 according to an instruction from the user. The printing apparatus 103 receives the print job from the PC 102 and performs printing according to the received print job. Further, the PC 102 acquires information on the status of the printing apparatus 103 from the printing apparatus 103 and displayed the information. Furthermore, the PC 102 receives an instruction for cleaning a fixing device of the printing apparatus 103 from the user and instructs the printing apparatus 103 to clean the fixing device.

The printing apparatus 103 may be a printing apparatus having only a print function for printing image data (print data) of a print job received from the PC 102 or a multifunction peripheral equipped with not only the print function but also a copy function for printing an image read from an original by a scanner. Alternatively, the printing apparatus 103 may be a facsimile machine equipped with a FAX reception function for receiving a facsimile image received via a telephone line and printing the received facsimile image. The present invention can be applied to any of the above-mentioned apparatuses.

Figure 2:
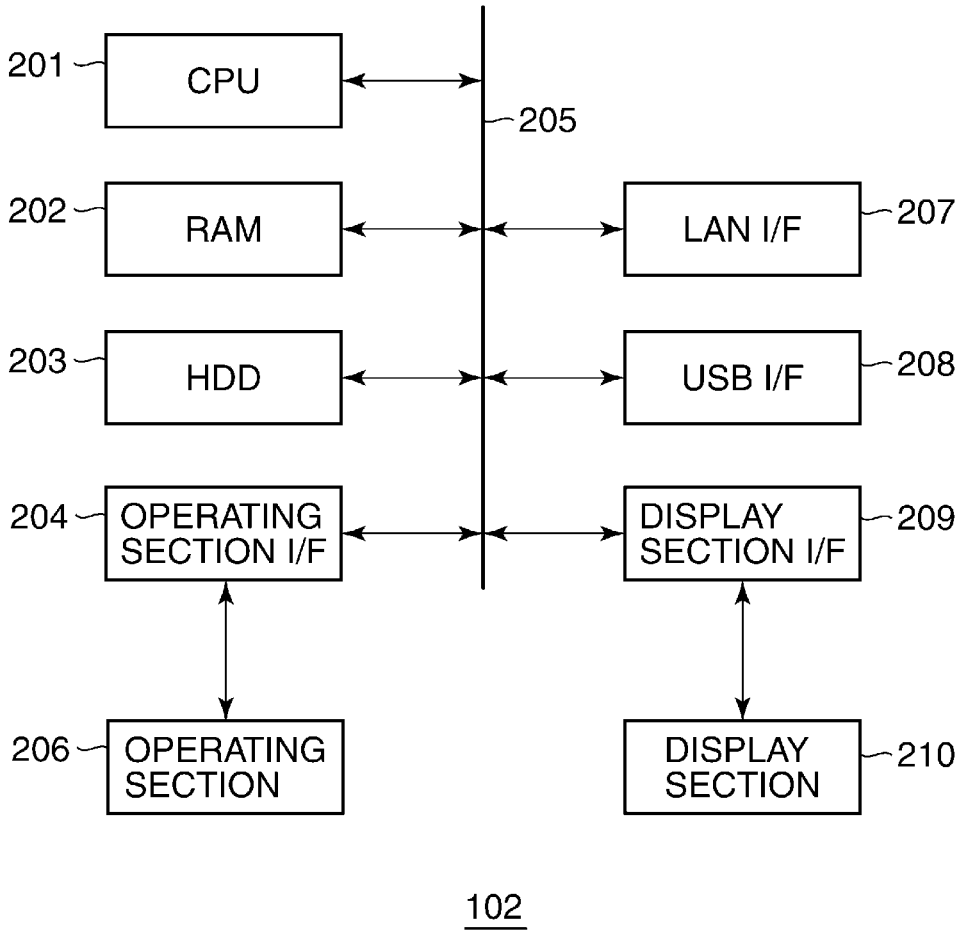
FIG. 2 is a block diagram of the hardware configuration of a PC appearing in FIG. 1.

FIG. 2 is a block diagram of the hardware configuration of the PC 102 appearing in FIG. 1.

The PC 102 comprises a CPU (central processing unit) 201, a RAM (random access memory) 202, a HDD (hard disk drive) 203, an operating section interface 204, a LAN interface 207, a USB interface 208, and a display section interface 209, all of which are interconnected via a system bus 205. The operating section interface 204 is connected to an operating section 206, and the display section interface 209 is connected to a display section 210.

The CPU 201 is a processor that controls the overall operation of the PC 102 in a centralized manner. The RAM 202 is a system work memory used by the CPU 201 when in operation. The HDD 203 is a storage device for storing programs and image data. The CPU 201 reads out and executes the programs stored in the HDD 203 to thereby perform various types of control.

The operating section interface 204 provides interface with the operating section 206. The operating section interface 204 passes an instruction input via the operating section 206 to the CPU 201. The operating section 206 includes e.g. a mouse and a keyboard. The display section interface 209 provides interface with the display section 210. The display section interface 209 outputs an output signal to the display section 210 according to control of the CPU 201. The display section 210 is implemented e.g. by a CRT display or a liquid crystal display.

The USB interface 208 provides interface for connection to a USB device. The USB interface 208 is used by the PC 102 so as to acquire the status of an external device or send the status of the PC 102 to the device via the USB cable.

The LAN interface 207 provides interface for connecting the PC 102 to the LAN. The LAN interface 207 is used by the PC 102 so as to acquire the status of an external device or send the status of the PC 102 to the device via the network.

Figure 3:
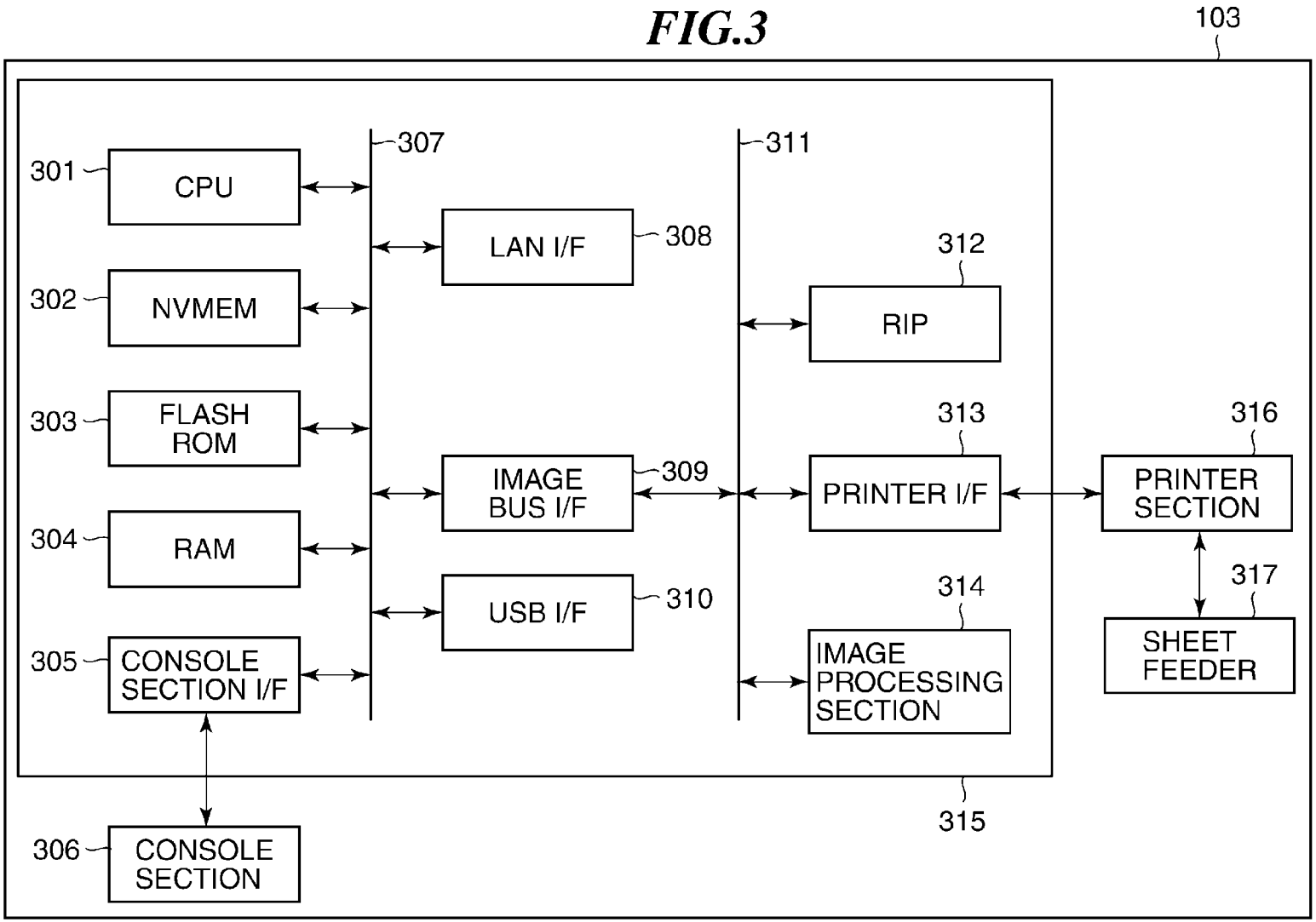
FIG. 3 is a block diagram of the hardware configuration of the printing apparatus appearing in FIG. 1.

FIG. 3 is a block diagram of the hardware configuration of the printing apparatus 103 appearing in FIG. 1.

The printing apparatus 103 comprises a controller unit 315, a console section 306, a printer section 316, and a sheet feeder 317.

The controller unit 315 includes a CPU 301, an NVMEM (nonvolatile memory) 302, a flash ROM 303, a RAM 304, and a console section interface 305. Further, the controller unit 315 includes a LAN interface 308, an image bus interface 309, a USB interface 310, a RIP (raster image processor) 312, a printer interface 313, and an image processing section 314.

The CPU 301 is a processor that controls the overall operation of the printing apparatus 103 in a centralized manner. The NVMEM 302 stores information on settings of the printing apparatus 103.

The flash ROM 303 is a rewritable nonvolatile memory. The flash ROM 303 stores various control programs for controlling the system. The RAM 304 is a system work memory used by the CPU 301 when in operation. The RAM 304 is used as a program memory for storing programs or an image memory for temporarily storing image data.

Figure 11A:
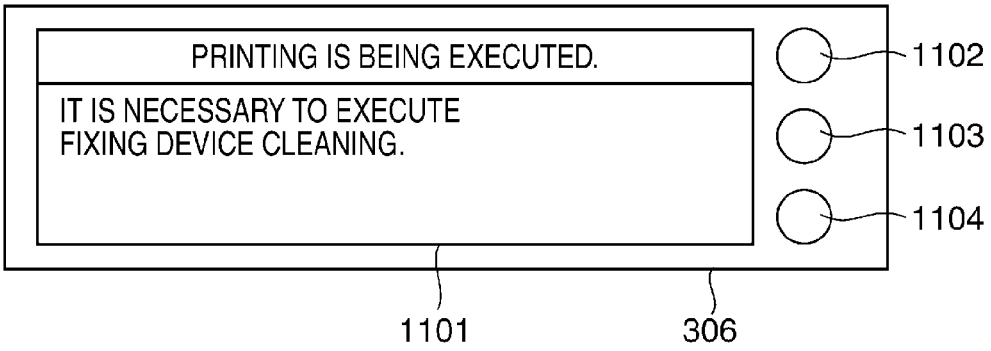

The console section 306 comprises a liquid crystal display, a touch panel integrally formed with the liquid crystal display, and hardware keys. The console section 306 displays an operation screen on the liquid crystal display and accepts an operation via the touch panel. FIG. 11A illustrates the appearance of the console section 306.

As shown in FIG. 11A, the console section 306 has an LCD display section 1101, a first operation key 1102, a second operation key 1103, and a third operation key 1104. The first operation key 1102 is used to give an instruction for cleaning the fixing device of the printing apparatus 103, and by pressing the first operation key 1102 in desired timing, it is possible to give the instruction for cleaning the fixing device. The second operation key 1103 is used to continue printing, and by pressing the second operation key 1103 in desired timing, it is possible to continue or restart printing. The third operation key 1104 is used to stop printing during execution of the printing by the printing apparatus 103, and by pressing the third operation key 1104 in desired timing, it is possible to stop printing.

Referring back to FIG. 3, the console section interface 305 provides interface with the console section 306. The console section interface 305 outputs display data to be displayed on the console section 306 to the same. Further, the console section interface 305 receives an instruction input by the user via the console section 306 and passes the instruction to the CPU 301.

The LAN interface 308 provides interface for connecting between the printing apparatus 103 and the LAN, and the image bus interface 309 is a bus bridge for connecting between a system bus 307 and an image bus 311 and converting a data structure. The USB interface 310 provides interface for connecting between the printing apparatus 103 and a USB device.

The CPU 301, the NVMEM 302, the flash ROM 303, the RAM 304, the console section interface 305, the LAN interface 308, the image bus interface 309, and the USB interface 310 are interconnected by the system bus 307.

The image bus 311 is implemented by a PCI bus or an IEEE 1394. Connected to the image bus 311 is not only the image bus interface 309 but also the RIP 312, the printer interface 313, and the image processing section 314. The RIP 312 converts vector data, such as PDL (page description language) code, received from the PC 102 into raster image data. The printer interface 313 connects the controller unit 315 to the printer section 316, and performs synchronous-to-asynchronous or asynchronous-to-synchronous conversion of image data and data exchange. The image processing section 314 performs correction, processing, and editing of image data, or correction, resolution conversion, etc. on image data to be printed out, so as to make the image data conformable to the printer section 316. Further, the image processing section 314 rotates image data, or compresses or expands e.g. multi-valued image data by JPEG, and binary image data by JBIG, MMR or MH.

The printer section 316 prints an image (raster image data) designated by the CPU 301 on a sheet fed from the sheet feeder 317. Note that the printing method which can be employed by the printer section 316 includes an electrophotographic method using a photosensitive drum or a photosensitive belt, an ink-jet method in which an image is printed by jetting ink from an array of very small nozzles, and so forth, and either of these methods may be employed.

The sheet feeder 317 comprises sheet feed cassettes containing respective types of sheets to be fed to the printer section 316, and rollers for feeding sheets from the respective sheet feed cassettes. The types of sheets that can be set in the sheet feeder 317 include the plain sheet, the recycled sheet, the thick sheet, the coated sheet, and the OHP sheet, by way of example. The sheet feeder 317 is only required to function as a sheet holder which is capable of holding sheets. Therefore, the sheet feeder 317 is not limited to a sheet cassette, but it may be a manual feed tray.

Figure 4:
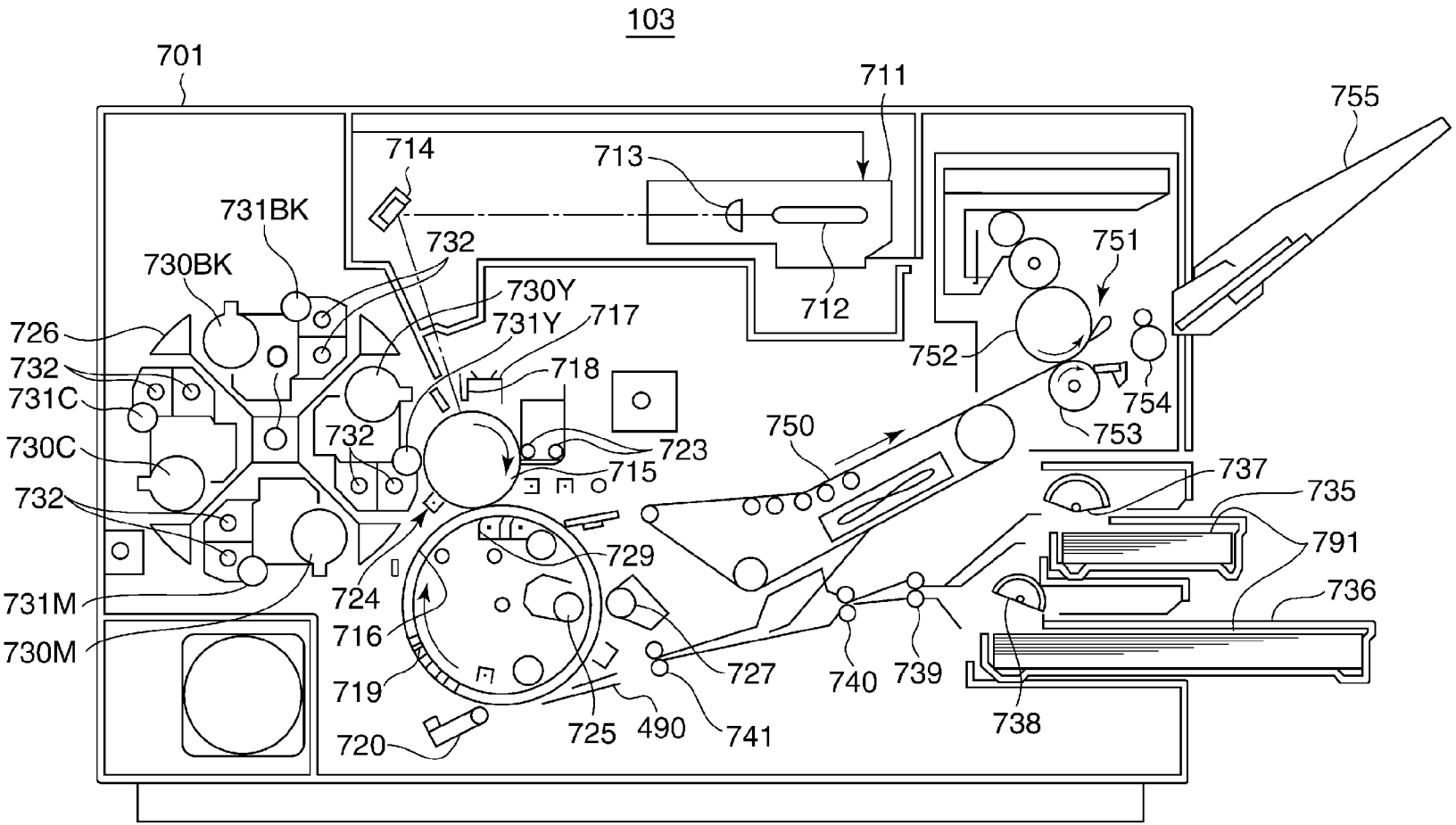
FIG. 4 is a schematic view useful in explaining the internal construction of the printing apparatus.

FIG. 4 is a schematic diagram showing the internal construction of the printing apparatus 103.

The printing apparatus 103 comprises a scanner section 711 and a printer section 701. The printer section 701 is substantially the same as the printer section 316 appearing in FIG. 3.

The scanner section 711 includes a laser output section (not shown) for converting an image signal to an optical signal, a polyhedral (e.g. octahedral) polygon mirror 712, a motor (not shown) for causing rotation of the polygon mirror 712, and an f/θ lens (imaging lens) 713. A laser beam emitted from the laser output section is reflected on one face of the polygon mirror 712, passes through the f/θ lens 713, is reflected on a reflective mirror 714, and thereby linearly scans (raster scans) the surface of a photosensitive drum 715 rotating in a direction indicated by an arrow in FIG. 4. This causes an electrostatic latent image corresponding to an original image to be formed on the surface of the photosensitive drum 715.

Around the photosensitive drum 715, there are arranged a primary charger 717, a whole-surface exposure lamp 718, a cleaner section 723 for collecting residual toner left untransferred, and a pre-transfer charger 724.

A developing device unit 726 develops an electrostatic latent image formed on the surface of the photosensitive drum 715 by laser exposure. The developing device unit 726 is configured as follows: Each of developing sleeves 731Y, 731M, 731C, and 731Bk is brought into contact with the photosensitive drum 715 to perform development directly. Each of toner cartridges 730Y, 730M, 730C, and 730Bk holds toner. Screw conveyors 732 convey developer. The developing sleeves 731Y, 731M, 731C, and 731Bk, the toner cartridges 730Y, 730M, 730C, and 730Bk, the screw conveyors 732 are arranged about a central shaft O of the developing device unit 726. Note that each of the reference symbols Y, M, C, and Bk attached to the reference numerals 730 and 731 denoting the respective components represents an associated color. More specifically, "Y" represents yellow, "M" magenta, "C" cyan, and "Bk" black.

When forming a yellow toner image, yellow toner development processing is performed in a position of the developing device unit 726 shown in FIG. 4. When forming a magenta toner image, the developing device unit 726 is turned about the shaft O appearing in FIG. 4, whereby the developing sleeve 731M in a magenta developing device is brought into contact with the photosensitive drum 715. Similar operation is performed for cyan and black developments.

A transfer drum 716 transfers a toner image formed on the photosensitive drum 715 onto a sheet. An actuator plate 719 detects a moved position of the transfer drum 716. When the actuator plate 719 comes close to a position sensor 720, the position sensor 720 senses the actuator plate 719 to thereby detect that the transfer drum 716 has moved to its home position.

The actuator plate 719, the position sensor 720, a transfer drum cleaner 725, a sheet holding roller 727, and a static eliminator 729 are arranged around the transfer drum 716. Sheet feed cassettes 735 and 736 contain sheets 791.

In the present embodiment, it is assumed that sheets e.g. of a size not larger than A5 (A5-size sheets, forms, postcards, etc.) can be set in the sheet feed cassette 735, and that sheets of a size not larger than A4 (A4-size sheets, A5-size sheets, forms, postcards, etc.) can be set in the sheet feed cassette 736. Sheets are fed from the sheet feed cassettes 735 and 736 by respective feed rollers 737 and 738. The sheet feeder 317 in FIG. 3 corresponds to the sheet feed cassettes 735 and 736 and the feed rollers 737 and 738.

Timing for feeding a sheet from the sheet feed cassette 735 or 736 and conveying the same is controlled by driving of timing rollers 739, 740, and 741. The sheet is guided to a sheet guide 490 via these timing rollers. Then, the sheet is wound around the transfer drum 716, and then an image forming process is started. The sheet having a toner image formed thereon is conveyed to a fixing device 751 by a sheet conveyance belt 750. The unfixed toner image on the sheet is fixed on the sheet by a heating roller 752 and a pressure roller 753 which are a pair of rotary members. The sheet having the image fixed thereon is discharged onto a discharge tray 755 by a discharge roller 754.

With the above-described construction, the printing apparatus 103 makes it possible to achieve full-color printing using the four colors Y, M, C, and Bk.

A description will be given of a case where the printing apparatus 103 according to the present embodiment feeds a cleaning sheet from the sheet feed cassette 736 and then passes the cleaning sheet through the fixing device 751 to thereby clean the heating roller 752 and the pressure roller 753 of the fixing device 751. An A4 sheet having the largest size of all the sheets that can be set in the sheet feed cassette 736 is longer in the conveying direction than an A5 sheet having the largest size of all the sheets that can be set in the sheet feed cassette 735, so that it is possible to obtain a greater cleaning effect. For this reason, the CPU 301 of the printing apparatus 103 requests the user to select the sheet feed cassette 736 between the two sheet feed cassettes 735 and 736 and set a cleaning sheet in the same, and feeds the cleaning sheet therefrom. However, the printing apparatus 103 may be configured such that a cleaning sheet can be fed from the sheet feed cassette 735.

The printing apparatus 103 of the present embodiment is capable of cleaning the fixing device by two cleaning methods.

Figure 5:
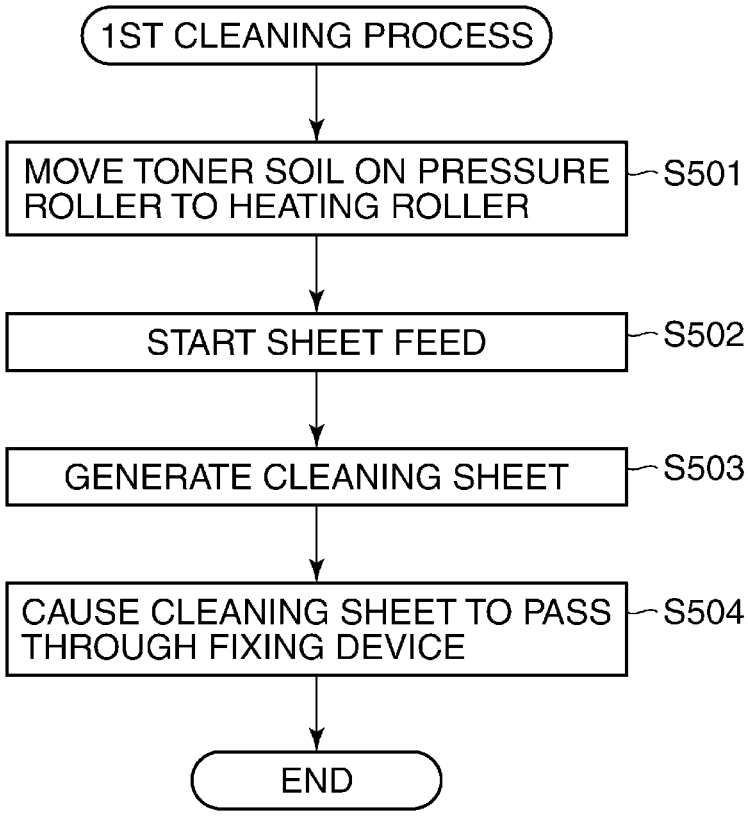
FIG. 5 is a flowchart of a first cleaning process for cleaning a fixing device, which is executed by the printing apparatus.

FIG. 5 is a flowchart of a first cleaning process based on a first cleaning method, for cleaning the fixing device 751, which is executed by the printing apparatus 103. The present process is executed by the CPU 301 by reading a program from the flash ROM 303 into the RAM 304 and executing the same.

In a step S501, when the user instructs the CPU 301 to clean the fixing device 751, the CPU 301 heats the heating roller 752 and then rotates the heating roller 752 and the pressure roller 753 with no sheet nipped therebetween, whereby toner having adhered to the pressure roller 753 is moved onto the heating roller 752.

Then, in a step S502, the CPU 301 causes one sheet (plain sheet in the present example) to be fed from the sheet feed cassette 736. This sheet is used as a cleaning sheet for cleaning the fixing device 751. Note that before starting sheet feed in the step S502, a confirmation screen may be displayed on the LCD display section 1101 of the console section 306, for prompting the user to confirm whether a sheet which can be used for cleaning the fixing device 751 has been set in the sheet feed cassette 736.

In the present embodiment, each of the heating roller 752 and the pressure roller 753 in the fixing device 751 has a width equal to or slightly larger than the length of the shorter side of an A4-size sheet. In order to clean the heating roller 752 and the pressure roller 753 having such a width, it is preferable to use an A4 sheet, and the A4 sheet is required to be set in the sheet feed cassette 736, with its shorter side orthogonal to the conveying direction. Therefore, the CPU 301 may display a request message prompting the user to set the A4 sheet with its shorter side properly directed with respect to the conveying direction, on the confirmation screen displayed in the step S502.

Figure 6:
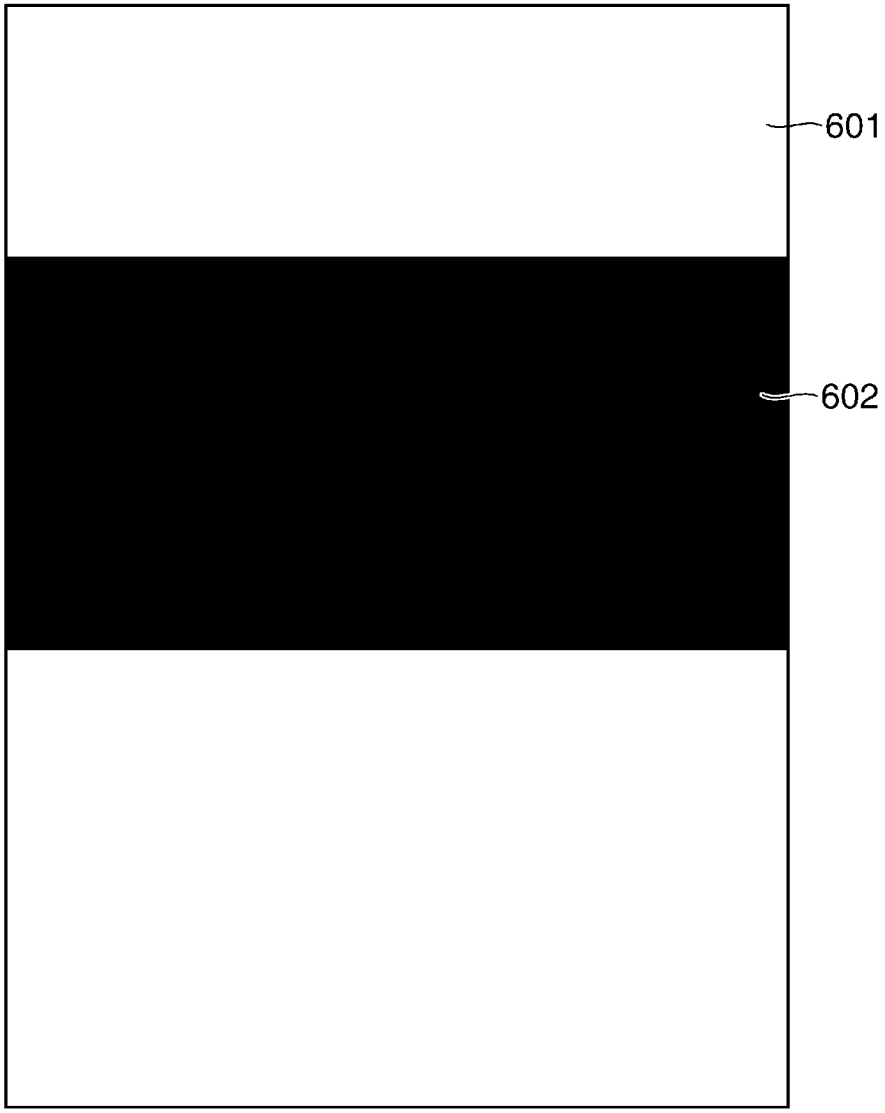
FIG. 6 is a view of an example of a cleaning sheet for use in cleaning of the fixing device.

In a step S503, the CPU 301 causes a toner image for cleaning to be transferred onto the sheet fed in the step S502, to thereby generate a cleaning sheet 601, as shown in FIG. 6. The cleaning sheet 601 has a belt image 602 printed thereon so as to enhance the effect in cleaning of the fixing device 751. Although in the present embodiment, the black belt image 602 is printed on the cleaning sheet 601, it is to be understood that a print image pattern of the belt image to be printed on the cleaning sheet 601 is not limited to this. Further, the cleaning sheet 601 may be used in a blank state without having any image printed thereon.

In a step S504, the CPU 301 causes the cleaning sheet 601 to be conveyed to the fixing device 751 and causes the nip formed by the heating roller 752 and the pressure roller 753 of the fixing device 751 to sandwich and convey the cleaning sheet 601 therethrough. Thus, toner soil on the heating roller 752 in contact with the cleaning sheet 601 is removed. Since toner soil on the pressure roller 753 has already been moved onto the heating roller 752 in the step S501, it can be said that this eventually cleans the pressure roller 753.

Figure 7:
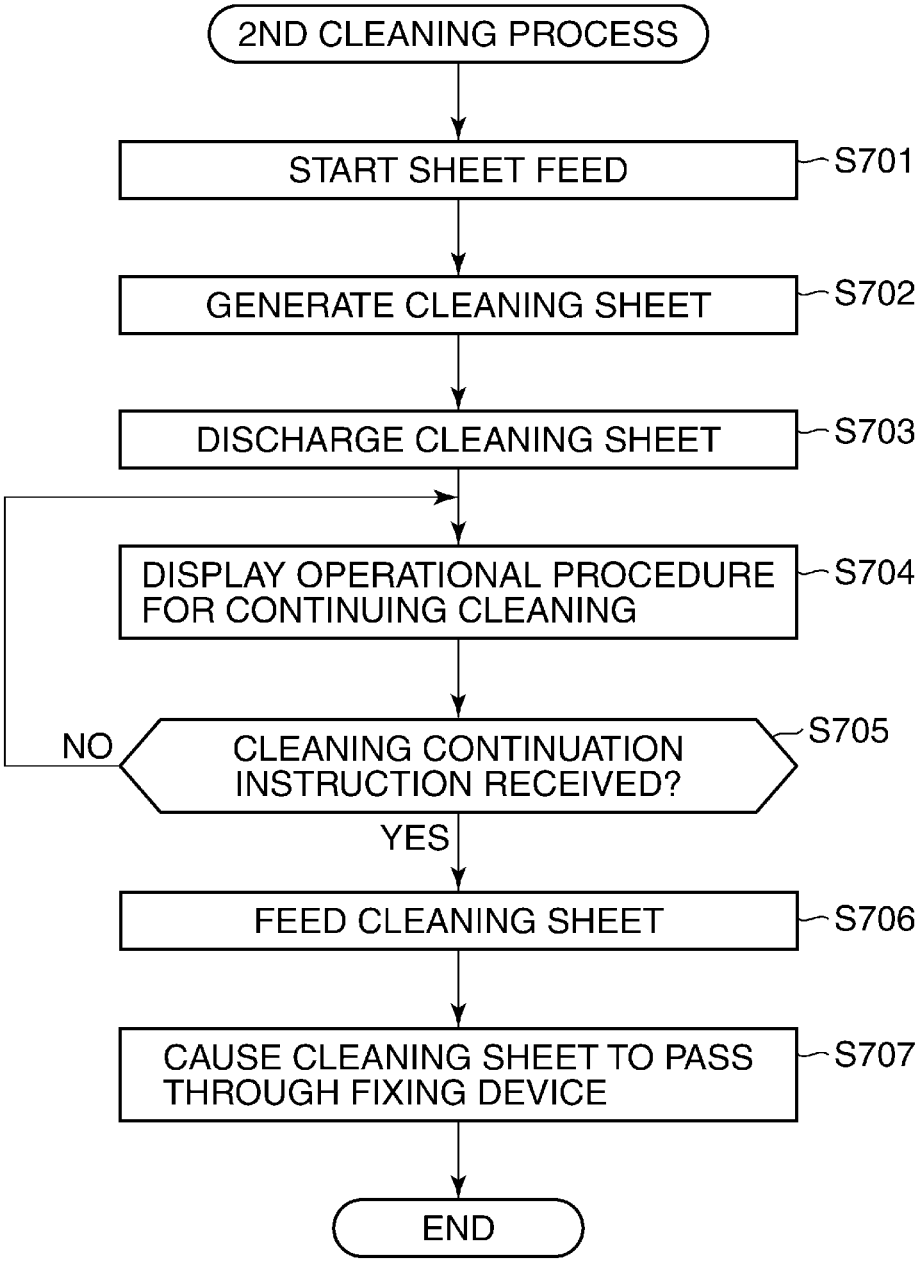
FIG. 7 is a flowchart of a second cleaning process for cleaning the fixing device, which is executed by the printing apparatus.

FIG. 7 is a flowchart of a second cleaning process based on a second cleaning method, for cleaning the fixing device 751, which is executed by the printing apparatus 103. The present process is executed by the CPU 301 by reading a program from the flash ROM 303 into the RAM 304 and executing the same.

In a step S701, when the user instructs the CPU 301 to clean the fixing device 751, the CPU 301 causes one sheet (plain sheet in the present example) to be fed from the sheet feed cassette 736. This sheet is used as a cleaning sheet for cleaning the fixing device 751. Note that a confirmation screen for prompting the user to confirm whether a sheet which can be used for cleaning the fixing device 751 has been set in the sheet feed cassette 736 may be displayed on the LCD display section 1101 of the console section 306 before sheet feed is started in the step S701. As described hereinabove, in the present embodiment, each of the heating roller 752 and the pressure roller 753 of the fixing device 751 has a width equal to or slightly larger than the length of the shorter side of an A4-size sheet. In order to clean the heating roller 752 and the pressure roller 753 having such a width, it is preferable to use an A4 sheet, and hence the A4 sheet is required to be set in the sheet feed cassette 736, with its shorter side orthogonal to the conveying direction. Therefore, the CPU 301 may display a request message prompting the user to set the A4 sheet with its shorter side properly directed with respect to the conveying direction, on the confirmation screen displayed in the step S701.

In a step S702, the CPU 301 causes the cleaning sheet 601 illustrated in FIG. 6 to be generated, as in the step S503 in FIG. 5.

In a step S703, the CPU 301 causes the fixing device 751 to fix the belt image 602 transferred onto the cleaning sheet 601 and then causes the discharge roller 754 to discharge the sheet.

In a step S704, the CPU 301 causes the LCD display section 1101 of the console section 306 to display an operational procedure for helping the user continue cleaning operation. The operational procedure for helping the user continue cleaning operation is a sequence of operations of setting the cleaning sheet 601 discharged in the step S703 in the sheet feed cassette 736, and feeding the same again. Specifically, the CPU 301 prompts the user to set the cleaning sheet 601 in the sheet feed cassette 736, such that a surface thereof having the belt image 602 printed thereon faces upward, i.e. such that the surface of the cleaning sheet 601 having the belt image 602 printed thereon faces the surface of the pressure roller 753.

Then, in a step S705, the CPU 301 determines whether or not an instruction for continuing the fixing device cleaning has been received from the console section 306 after the cleaning sheet 601 was set in the sheet feed cassette 736. If the CPU 301 determines that the instruction for continuing the fixing device cleaning has been received from the console section 306, the CPU 301 proceeds to a step S706, wherein the cleaning sheet 601 is fed.

In a step S707, the CPU 301 causes the cleaning sheet 601 to be conveyed to the fixing device 751 and then causes the nip formed by the heating roller 752 and the pressure roller 753 of the fixing device 751 to sandwich and convey the cleaning sheet 601 therethrough. At this time, the surface of the cleaning sheet 601 having the belt image 602 printed thereon is brought into contact with the pressure roller 753, so that toner soil on the pressure roller 753 is unstuck and removed by adhesive force generated between the belt image 602 on the cleaning sheet 601 and the toner soil. Thereafter, the cleaning sheet 601 is discharged onto the discharge tray 755 by the discharge roller 754.

The printing apparatus 103 executes the first cleaning process based on the first cleaning method or the second cleaning process based on the second cleaning method according to a request for cleaning the fixing device 751 which is received from the user via the console section 306. Further, in the printing apparatus 103, when the number of sheets printed after execution of cleaning reaches a predetermined sheet count, cleaning of the fixing device 751 is automatically performed.

Figure 8:
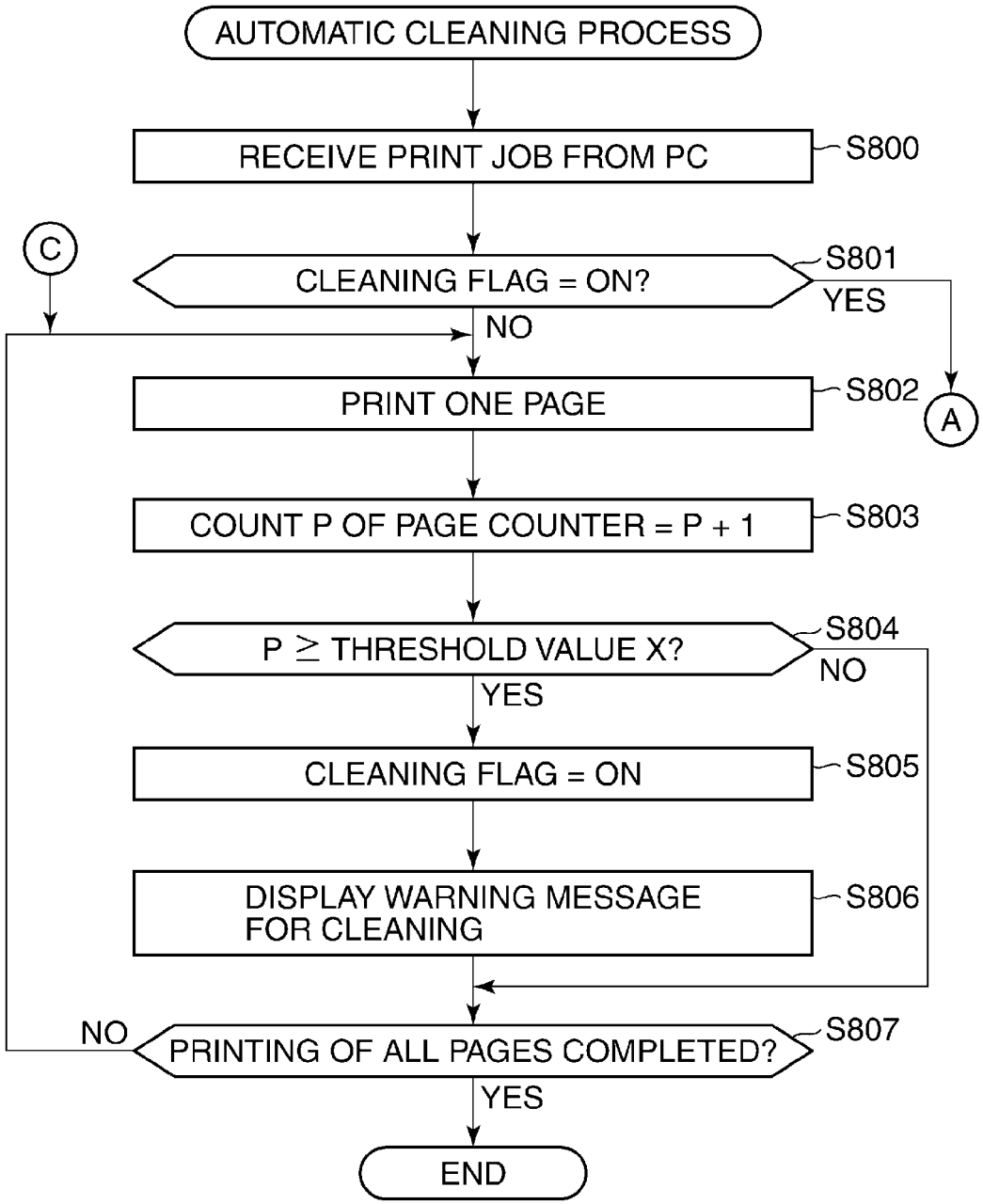
FIG. 8 is a flowchart of an automatic cleaning process for cleaning the fixing device, which is executed by the printing apparatus.
Figure 9:
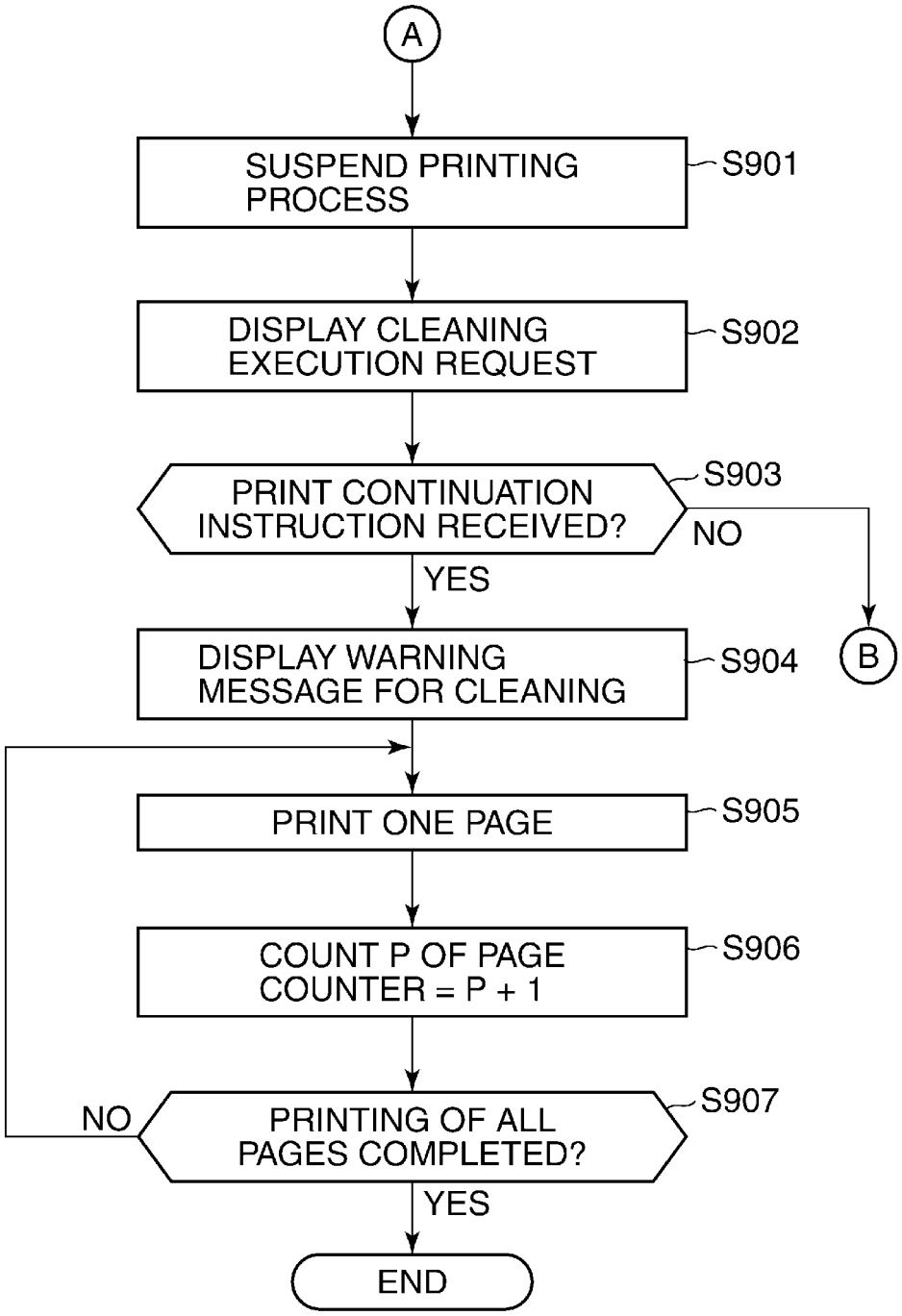
FIG. 9 is a continuation of FIG. 8.
Figure 10:
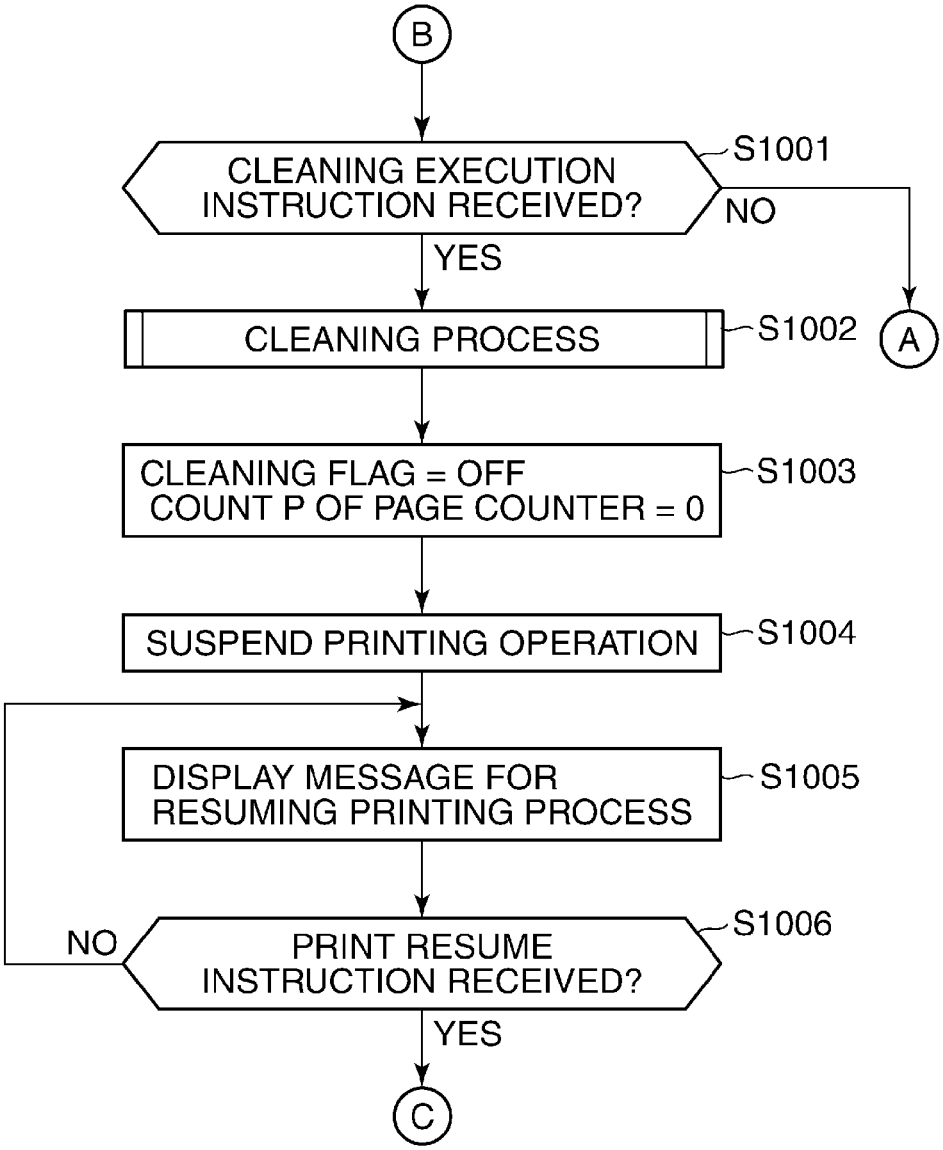
FIG. 10 is a continuation of FIG. 9.

FIGS. 8 to 10 are a flowchart of an automatic cleaning process which is executed by the printing apparatus 103, for automatically cleaning the fixing device 751. The present process is executed by the CPU 301 by reading a program from the flash ROM 303 into the RAM 304 and executing the same.

Figure 14:
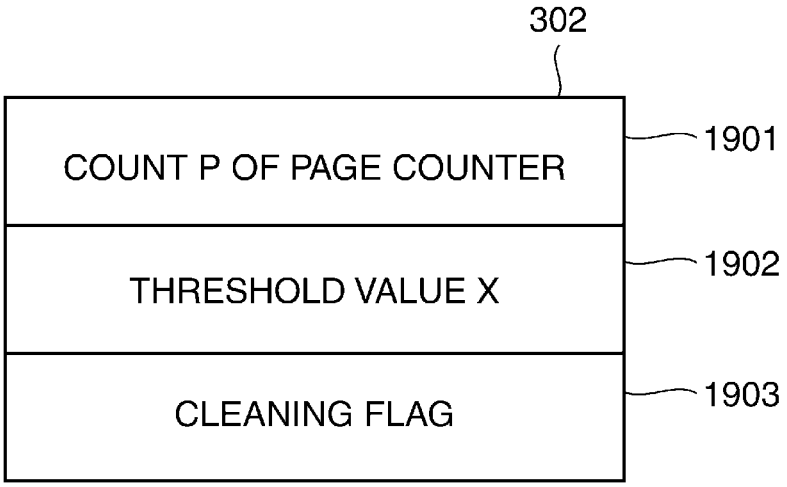
FIG. 14 is a diagram useful in explaining the outline of storage areas set in an NVMEM of the printing apparatus.

As shown in FIG. 8, first in a step S800, when the CPU 301 of the printing apparatus 103 has received a print job from the PC 102, i.e. has been instructed to perform printing according to the print job, the CPU 301 checks a cleaning flag indicative of whether or not the fixing device 751 is in a state requiring cleaning (step S801). The cleaning flag is set to on by the CPU 301 in a step S805, referred to hereinafter, when the count P of a page counter becomes equal to or larger than a threshold value X. The cleaning flag is stored in a predetermined storage area of the NVMEM 302 of the printing apparatus 103 as illustrated in FIG. 14.

In the NVMEM 302, there are formed a storage area 1901 for storing the count P of the page counter, a storage area 1902 for storing the threshold value X, and a storage area 1903 for storing a flag value (an on value or an off value) of the cleaning flag.

The count P of the page counter is incremented by 1 whenever one-page printing is performed on a sheet, and cleared to 0 whenever fixing device cleaning is performed.

The threshold value X is a value of the count of the page counter, which indicates that the fixing device 751 needs cleaning. The count P (current value thereof) of the page counter is compared with this value so as to determine whether or not it is currently required to execute cleaning of the fixing device 751.

The CPU 301 sets, updates, or refers to a value stored in each of the storage areas of the NVMEM 302.

If the CPU 301 refers, in the step S801, to the storage area 1903 of the NVMEM 302 and determines that the cleaning flag is off, the CPU 301 proceeds to a step S802. On the other hand, if the cleaning flag is on, the CPU 301 proceeds to a step S901 in FIG. 10.

In the step S802, the CPU 301 performs printing of one page of image data generated from a print job received from the PC 102. Note that a print job includes image data and print settings (print layout, print density, etc.) for printing the image data. In the present example, it is assumed that the CPU 301 of the printing apparatus 103 receives and prints image data from the PC 102 on a page-by-page basis. However, this is not limitative, but the present invention may be applied to a case where the printing apparatus 103 receives a plurality of print jobs each containing one or more pages from the PC 102 and stores the jobs in an HDD, not shown, provided in the printing apparatus 103, and thereafter sequentially executes the stored print jobs in the order of reception. Note that the CPU 301 and the image processing section 314 generates the image data from the print job in a printing process which is executed in combination with the automatic cleaning process shown in FIGS. 8 to 10.

When printing of one page in the step S802 is completed, the printed sheet is discharged by the discharge roller 754. In a step S803, the CPU 301 increments the count P of the page counter stored in the storage area 1901 of the NVMEM 302, by 1.

Then, in a step S804, the CPU 301 performs comparison between the count P of the page counter and the threshold value X stored in the storage area 1902 of the NVMEM 302, to thereby determine whether or not the count P of the page counter is equal to or larger than the threshold value X. In general, toner soil on the pressure roller 753 is proportional to the page count of sheets printed by the printing apparatus 103. For this reason, the CPU 301 judges the state of toner soil on the pressure roller 753 from the count P of the page counter stored in the NVMEM 302, and determines whether or not the fixing device 751 needs cleaning.

If the CPU 301 determines in the step S804 that the count P of the page counter is smaller than the threshold value X, the CPU 301 proceeds to a step S807. On the other hand, if it is determined in the step S804 that the count P of the page counter is not smaller than the threshold value X, the CPU 301 proceeds to the step S805, wherein the CPU 301 turns on the cleaning flag.

Then, in a step S806, the CPU 301 causes a warning message in FIG. 11A, which indicates that the fixing device 751 needs cleaning, to be displayed on the LCD display section 1101 of the console section 306. In the printing apparatus 103, when the number of printed sheets reaches a predetermined sheet count (threshold value X) during execution of printing, the warning message prompting the user to execute cleaning of the fixing device 751 is displayed. This makes it possible to notify the user of necessity of cleaning of the fixing device 751.

In the step S807, the CPU 301 determines whether or not printing of all pages has been completed. If printing of all the pages has not been completed, the CPU 301 returns to the step S802 to continue printing of the next and following pages. On the other hand, if printing of all pages has been completed, the CPU 301 terminates the present process.

Although in the present embodiment, determination as to whether or not it is required to execute cleaning of the fixing device 751 is performed based on the count of printed pages, the determination method is not limited to this. For example, cleaning may be performed whenever a predetermined time period elapses after execution of previous cleaning. Alternatively, cleaning may be performed whenever an environmental change occurs or whenever replacement of a part associated with the printing apparatus 103 is performed.

Next, a description will be given, with reference to FIGS. 9 and 10, of a printing operation performed after the fixing device 751 enters a state requiring cleaning, i.e. a case where it is determined in the step S801 in FIG. 8 that the cleaning flag is on (YES to the step S801).

Figure 11B:
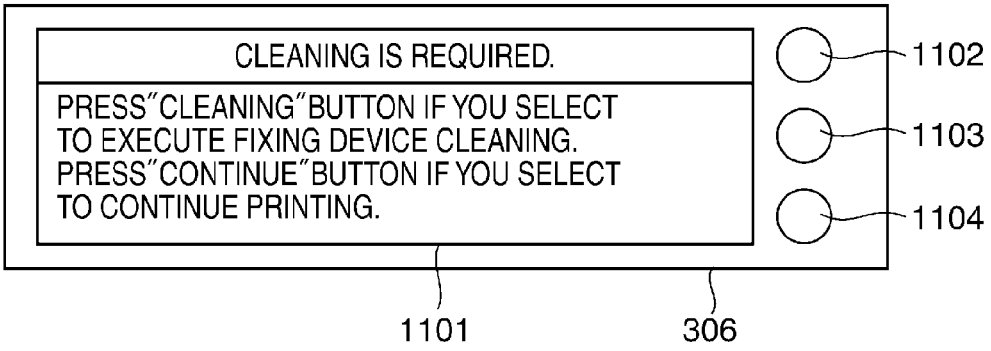

If the answer to the question of the step S801 in FIG. 8 is affirmative (YES), the CPU 301 proceeds to the step S901 in FIG. 9. In the step S901, the CPU 301 suspends the printing process according the print job received from the PC 102 in the step S800 in FIG. 8 before starting printing operation therefor. After suspending the printing operation, the CPU 301 causes the LCD display section 1101 of the console section 306 to display a message requesting the user to execute cleaning of the fixing device 751 in a step S902, as shown in FIG. 11B. In doing this, the CPU 301 performs display for prompting the user to confirm whether or not a sheet suitable for cleaning has been set in the sheet feed cassette 736, as mentioned hereinabove in the description of the processes shown in FIGS. 5 and 7. Further, the CPU 301 may display the size and type of the sheet suitable for cleaning. By thus suspending the printing operation and displaying the messages shown in FIG. 11B, it is possible to cause the user to select whether to execute cleaning of the fixing device 751 or to continue printing without execution of cleaning of the fixing device 751. If the first operation key 1102 is pressed at this time, the CPU 301 proceeds to execution of cleaning of the fixing device 751. On the other hand, if the second operation key 1103 is pressed, the suspended printing is continued without execution of cleaning of the fixing device 751.

More specifically, the CPU 301 determines in a step S903 whether or not a print continuation instruction has been received from the user instead of an instruction for cleaning the fixing device 751. If it is determined that the second operation key 1103 has been pressed and hence the print continuation instruction has been received (YES to the step S903), printing is continued without execution of cleaning of the fixing device 751. Therefore, the CPU 301 causes the warning message indicative of necessity of cleaning of the fixing device 751 to be displayed on the LCD display section 1101 of the console section 306 (step S904).

Then, in a step S905, the CPU 301 performs printing of image data of one page generated from the print job received from the PC 102 while continuously displaying the message displayed in the step S904. Note that the CPU 301 and the image processing section 314 generates the image data from the print job, as mentioned hereinabove, in the printing process which is executed in combination with the automatic cleaning process shown in FIGS. 8 to 10.

When printing of one page in the step S905 is completed and the printed sheet is discharged by the discharge roller 754, the CPU 301 increments the count P of the page counter by 1 (step S906). The count P of the page counter is stored in the storage area 1901 in the NVMEM 302 and managed by the CPU 301, as described hereinabove.

In a step S907, the CPU 301 determines whether or not printing of all pages has been completed. If it is determined that printing of all the pages has been completed, the CPU 301 terminates the present process, whereas if not, the CPU 301 returns to the step S905 to continue printing of the next and following pages.

If it is determined in the step S903 that the second operation key 1103 has not been pressed and hence the print continuation instruction has not received (NO to the step S903), the CPU 301 proceeds to a step S1001 in FIG. 10 to determine whether or not a cleaning execution instruction has been received via the console section 306, i.e. whether or not the first operation key 1102 has been pressed. If the cleaning execution instruction has not been received (NO to the step S1001), the CPU 301 returns to the step S901 in FIG. 9. On the other hand, if the cleaning execution instruction has been received (YES to the step S1001), the CPU 301 proceeds to a step S1002.

In the step S1002, the CPU 301 executes a cleaning process for cleaning the fixing device 751. Details of the cleaning process for cleaning the fixing device 751 are as described hereinabove with reference to FIGS. 5 to 7. In the present process, either of the first cleaning process based on the first cleaning method and the second cleaning process based on the second cleaning method may be executed.

When the cleaning process for cleaning the fixing device 751 executed in the step S1002 is completed, the CPU 301 changes the cleaning flag in the NVMEM 302 from on to off and clears the count P of the page counter to 0 in a step S1003.

In a step S1004, the CPU 301 carries out processing for resuming the printing process, but suspends the printing operation before resuming the same.

Figure 11C:
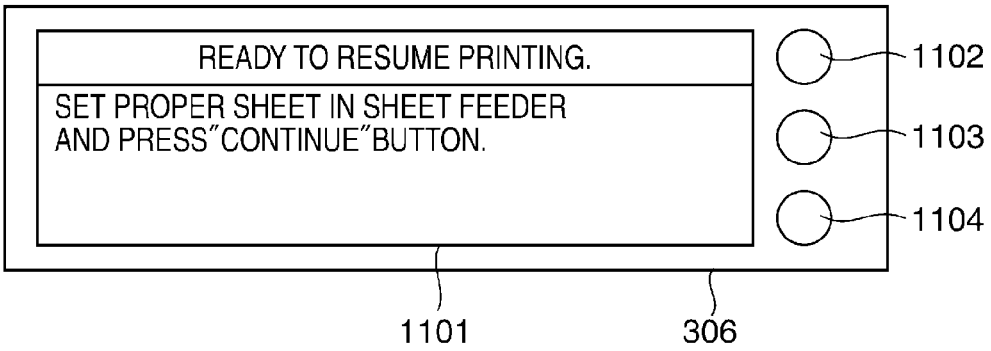

Then, in a step S1005, the CPU 301 causes the LCD display section of the console section 306 to display a message requesting the user to set sheets of correct size for next printing in the sheet feed cassette 736, as illustrated in FIG. 11C. In doing this, the CPU 301 causes a message to be displayed which requests the user to set sheets of the print job received from the PC 102 in the step S800 in FIG. 8, in the sheet feed cassette 736. Further, when the size and type of sheets of the print job can be recognized, the CPU 301 may display the size and type of sheets. Since it is immediately after the cleaning process in the step S1002 is completed, printing of image data of the print job to be executed has not been started yet. Therefore, the CPU 301 causes a message requesting the user to give an instruction for resuming printing to be displayed on the console section 306. The message prompting the user to check setting of sheets is thus displayed before resuming printing operation, to thereby prompt the user to check whether or not correct sheets for printing have been set in the sheet feed cassette 736 before resuming printing after execution of cleaning of the fixing device 751. Further, a message may be displayed which notifies the user that printing can be resumed by pressing an operation key (the second operation key 1103 in the present embodiment).

Then, in a step S1006, the CPU 301 determines whether or not a print resuming instruction has been received from the user. If it is determined that the print resuming instruction has been issued, the CPU 301 proceeds to the step S802, wherein the CPU 301 executes printing according to the print job. For example, when the second operation key 1103 is pressed, the CPU 301 proceeds to the step S802, wherein the CPU 301 starts printing of a page of the print job to be executed.

Execution of the above-described control enables the user to select a desired one of the first cleaning process and the second cleaning process and cause the printing apparatus 103 to execute the selected cleaning process. Further, when the fixing device 751 needs cleaning, the user can recognize, by viewing a screen on the console section 306, that fixing device cleaning is required.

Furthermore, in the case of executing cleaning of the fixing device 751, the user is prompted to check whether or not a sheet of a size which can be used (which is suitable) for the cleaning has been set in the sheet feed cassette 736. This makes it possible to prevent a sheet of a size which cannot be used (which is unsuitable) for the cleaning from being used for the cleaning. For example, even when the time for cleaning comes while printing is being performed using special sheets, such as pre-printed sheets or forms, prepared in advance, it is possible to prevent the special sheet from being used for the cleaning.

Further, after execution of cleaning, the printing apparatus 103 prompts the user to check whether or not sheets for use in next printing have been set in the sheet feed cassette 736. This enables the user to properly set sheets for use in printing to be performed after execution of cleaning, and execute the printing after the cleaning. Specifically, there is a case where after receiving a job of printing in which the use of sheets of a certain size is designated, from the PC 102, the printing apparatus 103 judges that it is necessary to execute cleaning. In such a case, the printing apparatus 103 requests the user to set a sheet of a size suitable for cleaning in the sheet feed cassette, irrespective of the size designated in the job. Then, before starting printing in the job after completion of the cleaning, it is possible to cause the user to properly set the sheets of the size designated by the job, irrespective of the size of the cleaning sheet, and then start the printing.

Although in the above-described embodiment, operation screens and messages are displayed on the console section 306 of the printing apparatus 103, the operation screens and the messages may be displayed on the display section 210 of the PC 102.

FIGS. 12A and 12B and FIGS. 13A and 13B are views each illustrating an operation screen displayed on the display section 210 of the PC 102. Each of these operation screens is displayed by the CPU 201 executing application software stored in the HDD 203 of the PC 102.

Figure 12A:
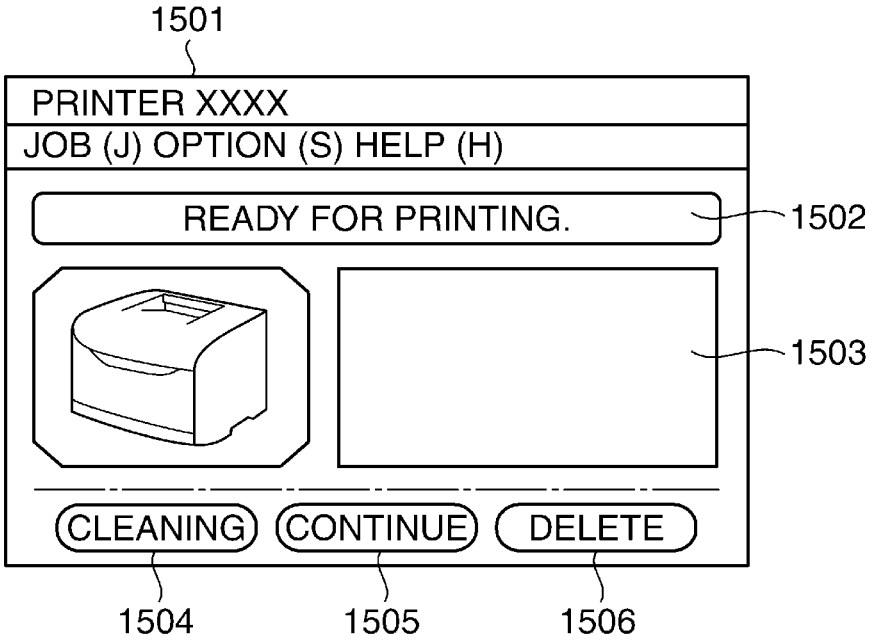

A screen 1501 in FIG. 12A is an example of a default screen displayed when an application for operating the printing apparatus 103 is started.

A status display section 1502 is a display box for displaying the status of the printing apparatus 103. The CPU 201 of the PC 102 sends a request for acquiring the status of the printing apparatus 103 to the printing apparatus 103 and displays the status of the printing apparatus 103 sent from the printing apparatus 103 in the status display section 1502.

An auxiliary message display section 1503 displays a message to be notified to the user.

Further, on the screen 1501, there are displayed a fixing device cleaning execution instruction button 1504, a print continuation instruction button 1505, and a print job deletion instruction button 1506. These buttons are used to give respective instructions to the printing apparatus 103. These buttons have functions similar to those of the first operation key 1102, the second operation key 1103, and the third operation key 1104, appearing in FIG. 11A, respectively. Specifically, the fixing device cleaning execution instruction button 1504 is used to give an instruction for execution of fixing device cleaning, and by pressing the fixing device cleaning execution instruction button 1504 in required timing, it is possible to give an instruction for performing a fixing device cleaning operation. The print continuation instruction button 1505 is used to give an instruction for continuing printing, and by pressing the print continuation instruction button 1505 in required timing, it is possible to give an instruction for continuing or resuming the printing. The print job deletion instruction button 1506 is used to give an instruction for deleting a print job currently processed in the printing apparatus 103, and by pressing the print job deletion instruction button 1506 in desired timing, it is possible to give an instruction for deleting the print job. When one of these buttons is pressed, the PC 102 gives the associated execution instruction to the printing apparatus 103 via the LAN interface 207 or the USB interface 208 to thereby cause the printing apparatus 103 to execute the associated operation.

Figure 12B:
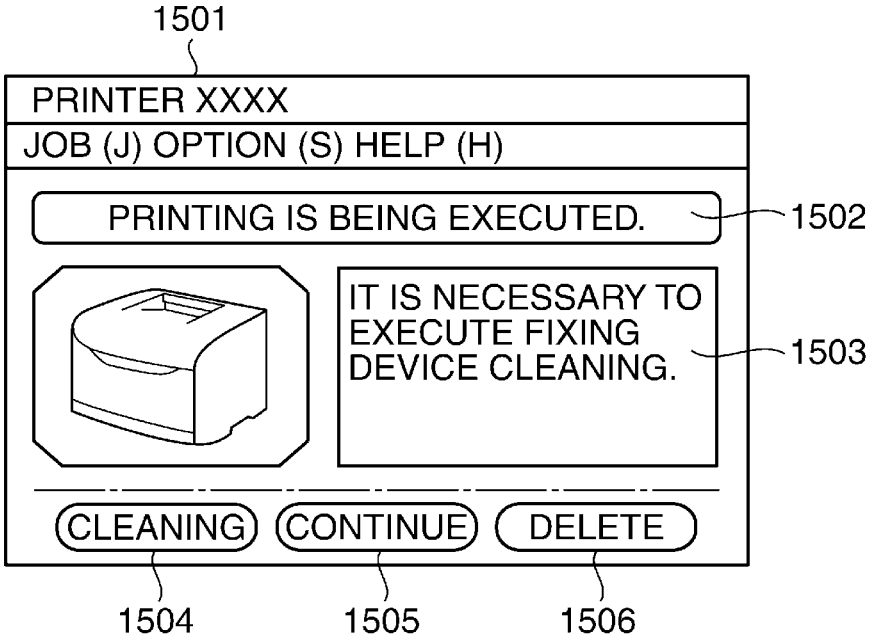

FIG. 12B is a view illustrating an example of a screen displayed on the display section 210 of the PC 102 in the step S806 in FIG. 8.

By displaying a warning message appearing in FIG. 12B on the auxiliary message display section 1503, it is possible to notify the user that fixing device cleaning is required to be executed.

Figure 13A:
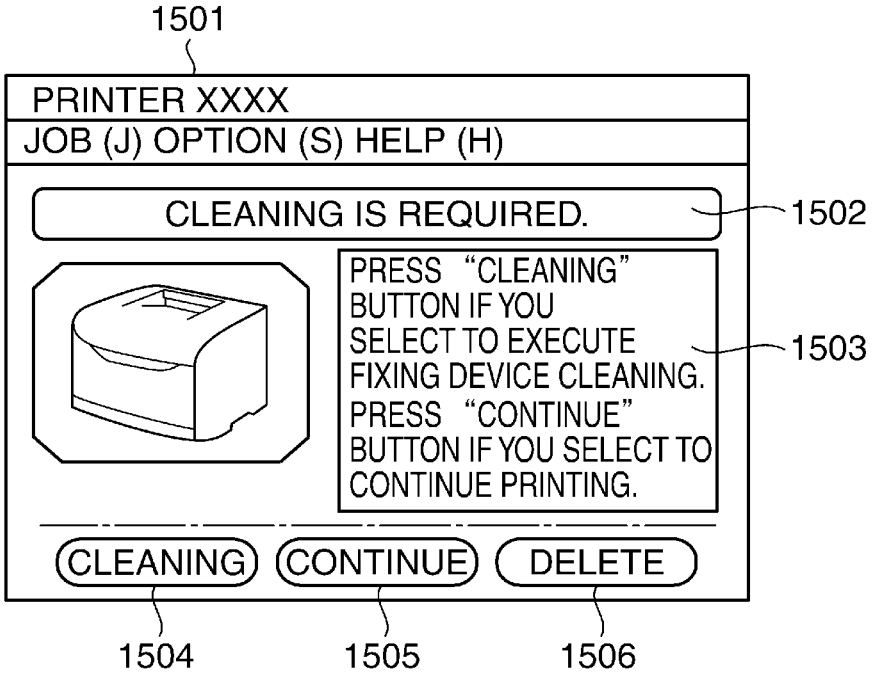

FIG. 13A is a view illustrating an example of a screen displayed on the display section 210 of the PC 102 in the step S902 in FIG. 9.

When the printing process is suspended in the step S902, messages appearing in FIG. 13A are displayed on the status display section 1502 and the auxiliary message display section 1503, respectively. This can prompt the user to select whether to execute fixing device cleaning or execute printing without execution of fixing device cleaning. When the fixing device cleaning execution instruction button 1504 is pressed at this time (step S1001), the fixing device cleaning execution instruction is issued to the printing apparatus 103. Alternatively, when the print continuation instruction button 1505 is pressed (step S903), the printing apparatus 103 is instructed to continue the suspended printing operation without execution of fixing device cleaning.

Figure 13B:
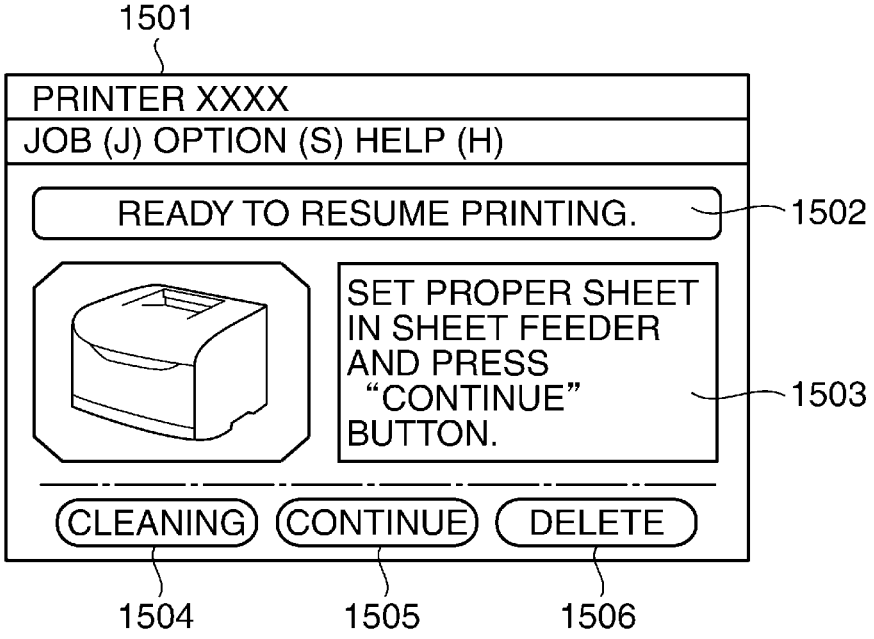

FIG. 13B is a view illustrating an example of a screen displayed on the display section 210 of the PC 102 in the step S1005 in FIG. 10.

When the printing process is suspended in the step S1005, messages appearing in FIG. 13B are displayed on the status display section 1502 and the auxiliary message display section 1503, respectively. This can prompt the user to check whether or not sheets for use in printing have been set in the sheet feeder 317, before resuming printing after execution of fixing device cleaning. Further, it is possible to notify the user that printing can be resumed by pressing the print continuation instruction button 1505 on the screen. When the print continuation instruction button 1505 is pressed at this time, the printing apparatus 103 is instructed to continue the suspended printing operation.

According to the first embodiment, at the start of a printing process according to a print job, the printing process is once suspended to execute fixing device cleaning, and then, the printing process is not immediately resumed but the screen illustrated in FIG. 11B is displayed. This makes it possible to prevent an image from being printed on a sheet of a size not intended by the user.

A printing system including a printing apparatus according to a second embodiment, the printing apparatus, and an information processing apparatus in the second embodiment have substantially the same arrangements as those described in the first embodiment. Therefore, components corresponding to those in the first embodiment are denoted by the same reference numerals, and description thereof is omitted. In the following, a description will be given only of different points from the first embodiment.

In the printing apparatus 103 of the first embodiment, when it is determined that fixing device cleaning is required, the screen illustrated in FIG. 13A is displayed so as to prompt the user to give the cleaning execution instruction. If the print continuation instruction button 1505 is pressed on this screen, it is possible to continue the print job without executing fixing device cleaning.

However, if printing is continued without execution of fixing device cleaning, toner soil on the fixing device increases, which can cause stain on a printed image.

The printing apparatus 103 according to the second embodiment aims to reduce the possibility of a printed image being stained by soil on the fixing device which increases when printing is continued without execution of fixing device cleaning.

Figure 15:
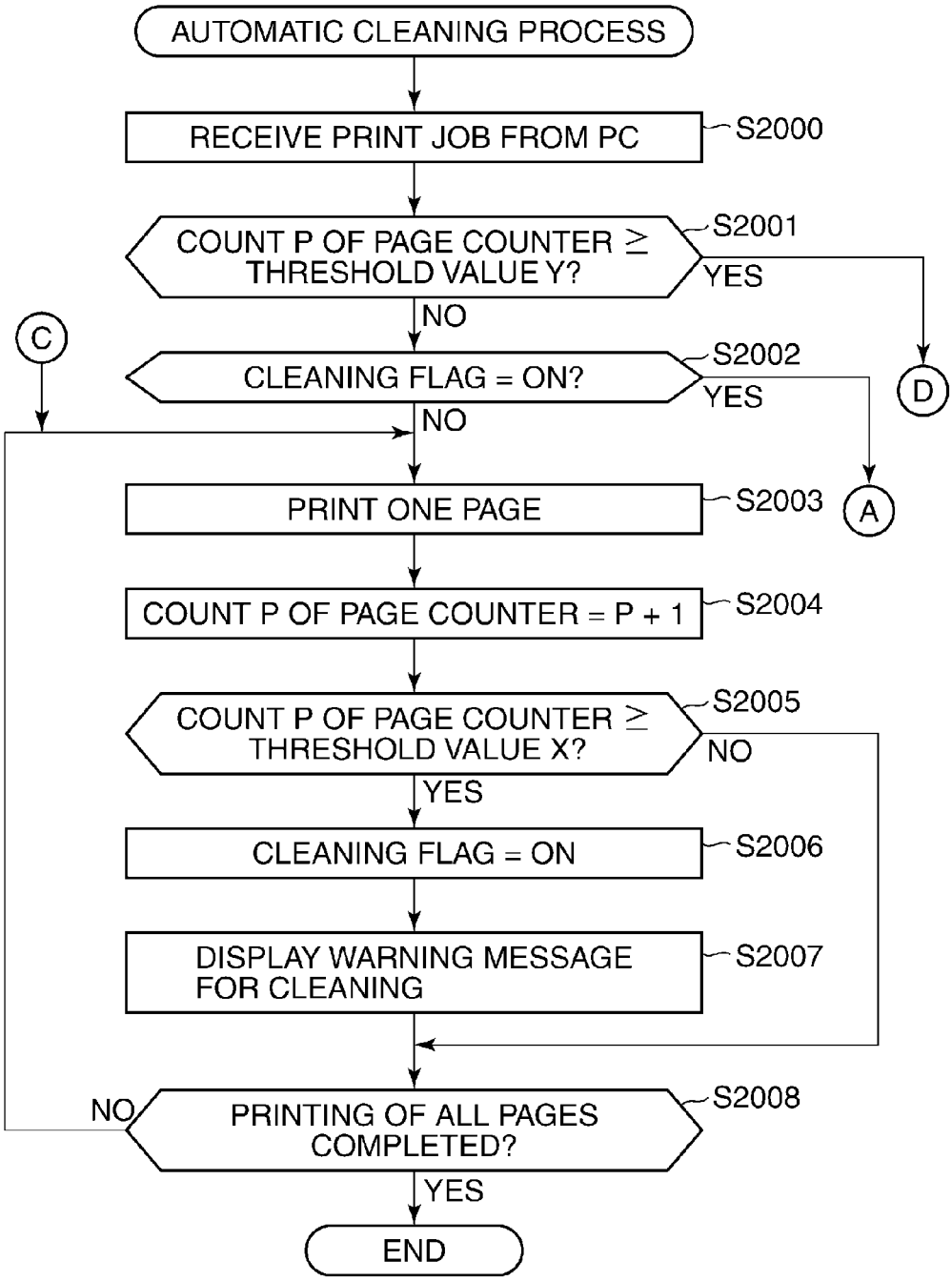
FIG. 15 is a flowchart of an automatic cleaning process which is executed by a printing apparatus according to a second embodiment of the present invention, for cleaning a fixing device of the printing apparatus.
Figure 16A:
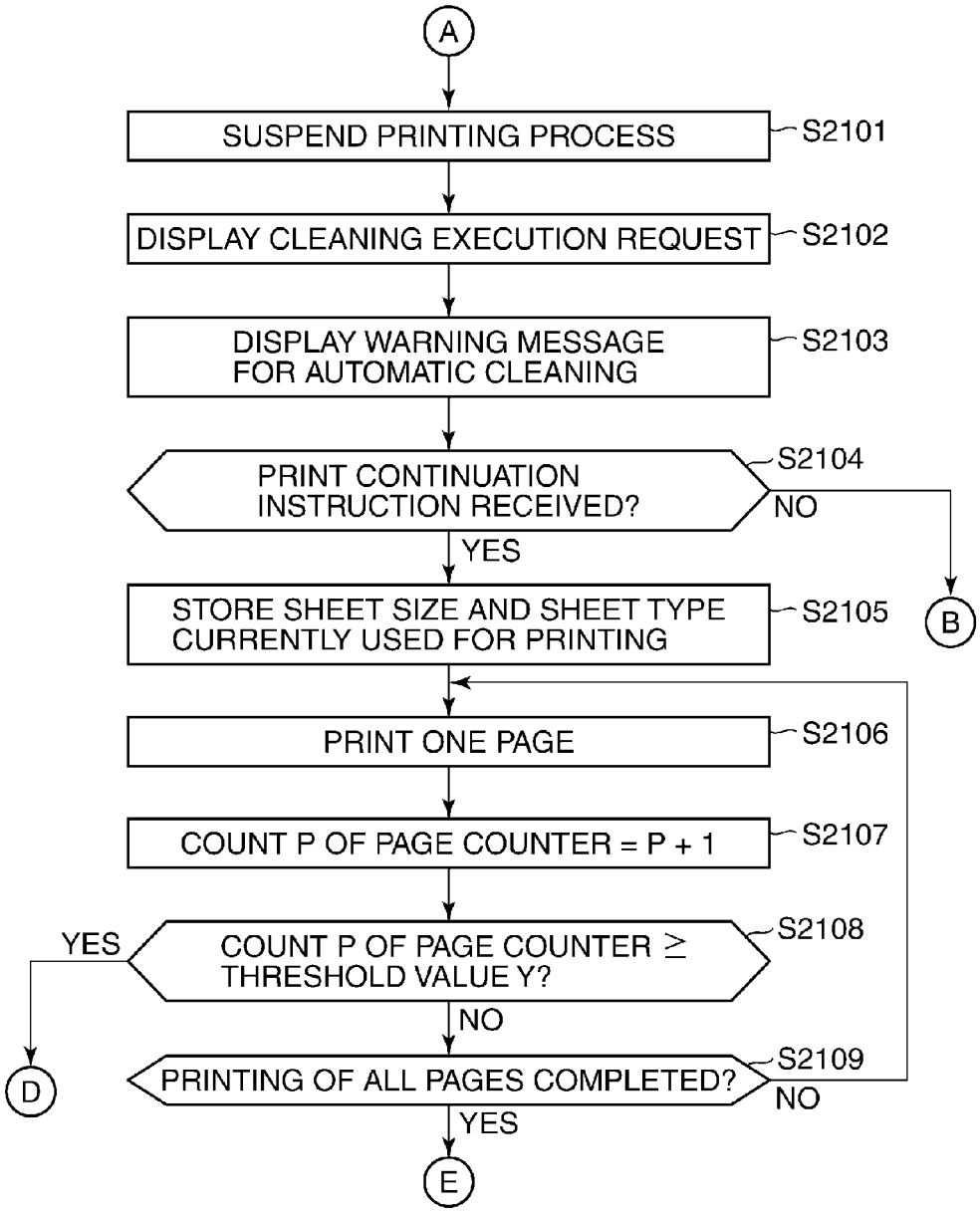
FIG. 16A is a continuation of FIG. 15.
Figure 16B:
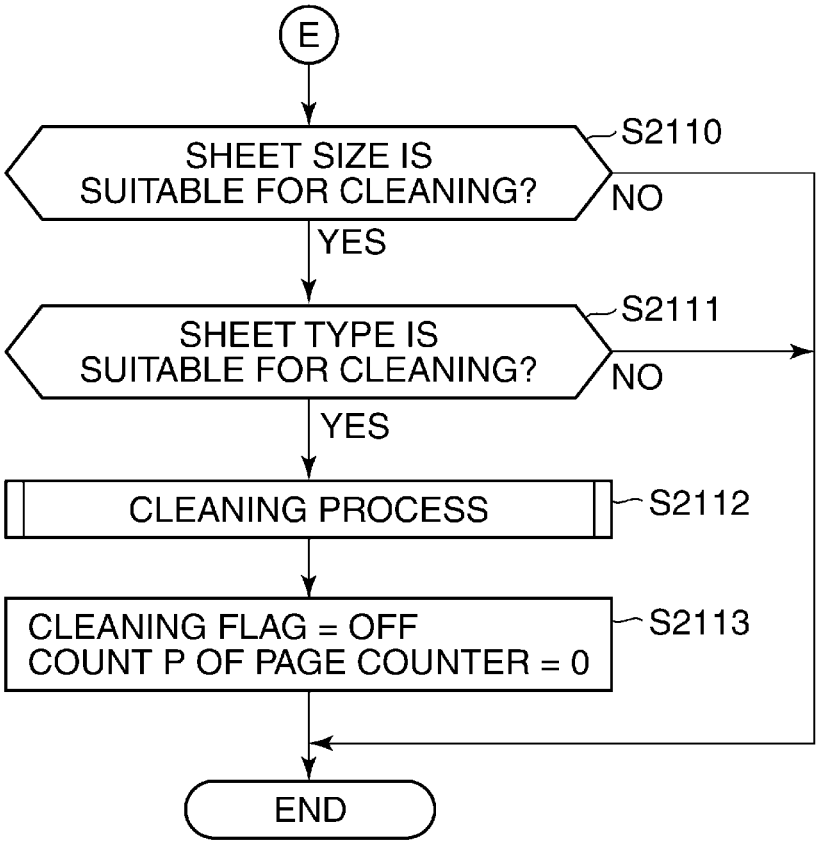
FIG. 16B is a continuation of FIG. 16A.
Figure 17:
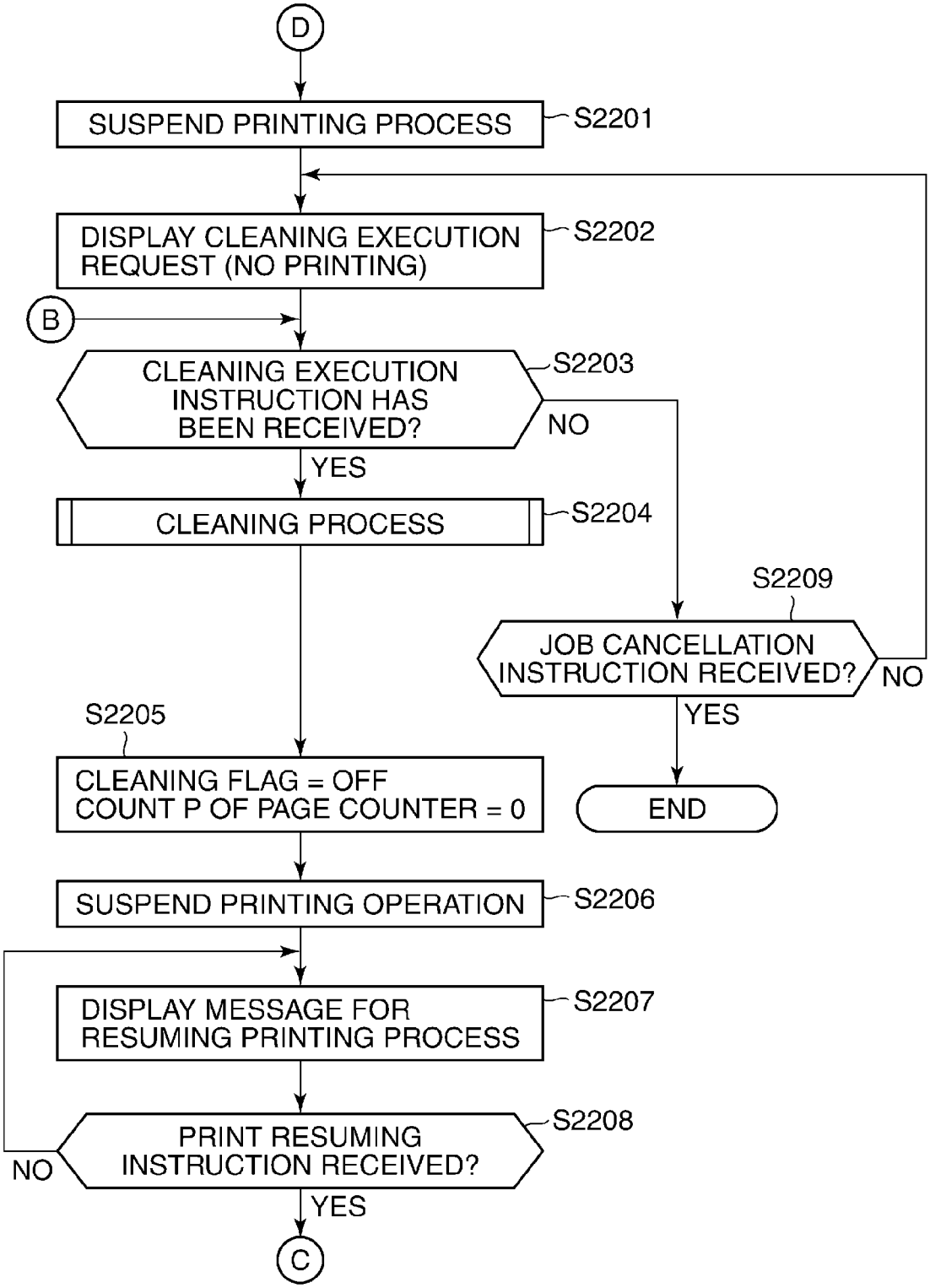
FIG. 17 is a continuation of FIG. 16A.

FIGS. 15 to 17 are a flowchart of an automatic cleaning process executed in the second embodiment, for automatically cleaning the fixing device 751. The present process is executed by the CPU 301 by reading a program from the flash ROM 303 into the RAM 304 and executing the same.

First, a description will be given, with reference to FIG. 15, of a case in the present automatic cleaning process, where a warning message prompting the user to execute fixing device cleaning is displayed during execution of printing.

Figure 20:
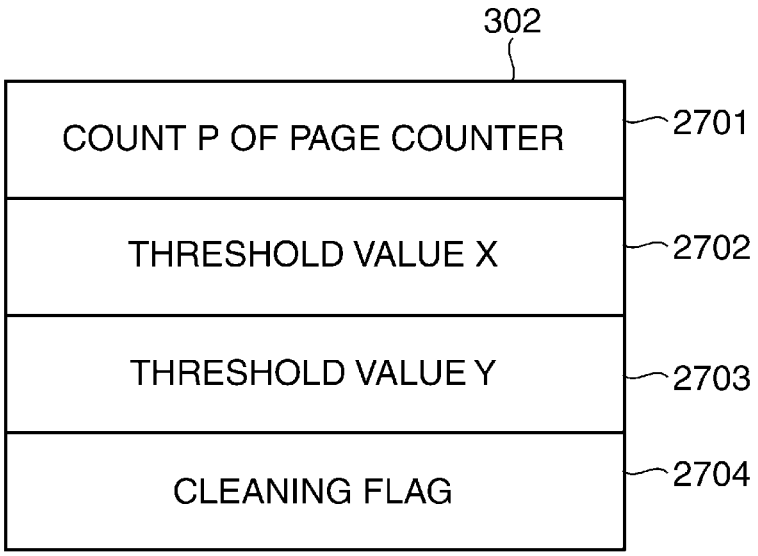
FIG. 20 is a diagram useful in explaining the outline of storage areas set in an NVMEM of the printing apparatus according to the second embodiment.

In a step S2000, when the CPU 301 of the printing apparatus 103 has received a print job from the PC 102, i.e. when the user has instructed the printing apparatus 103 from the PC 102 to perform printing according to the print job, the CPU 301 performs comparison between the count P (current value thereof) of the page counter and a threshold value Y to determine whether or not the count P of the page counter is equal to or larger than the threshold value Y (step S2001). The count P of the page counter and the threshold value Y are stored in respective predetermined storage areas in the NVMEM 302 as illustrated in FIG. 20.

The NVMEM 302 has a storage area 2701 for storing the count P of the page counter indicative of a value obtained by counting printed sheets, a storage area 2702 for storing the threshold value X, and a storage area 2703 for storing the threshold value Y. Further, the NVMEM 302 has a storage area 2704 for storing the value of the cleaning flag.

The count P of the page counter is incremented by 1 whenever the printing apparatus 103 prints one page on a sheet, and is cleared to 0 whenever fixing device cleaning is performed.

The threshold value X is a value of the count P of the page counter, which indicates that the fixing device 751 needs cleaning. The count P (current value thereof) of the page counter is compared with this value so as to determine whether or not it is currently required to execute cleaning of the fixing device 751. The threshold value Y is a value of the count P of the page counter indicative of an upper limit number of times of operations of the fixing device 751 in a case where the fixing device 751 is continuously used without execution of fixing device cleaning. The CPU 301 compares the count P (current value thereof) of the page counter with the threshold value Y to thereby determine whether or not the fixing device 751 is in an unusable state due to toner soil.

A value stored in each of the storage areas in the NVMEM 302 is set, updated, or referred to by the CPU 301.

In general, toner soil on the pressure roller 753 is proportional to the page count of sheets printed by the printing apparatus 103. For this reason, the CPU 301 judges the state of toner soil on the pressure roller 753 from the count P of the page counter stored in the NVMEM 302, and determines whether or not the fixing device 751 needs cleaning and whether or not the use of the fixing device 751 can be continued.

If it is determined in the step S2001 that the count P of the page counter is smaller than the threshold value Y (NO to the step S2001), the CPU 301 proceeds to a step S2002, wherein the CPU 301 checks the cleaning flag indicative of whether or not the fixing device 751 is in a state requiring cleaning. The cleaning flag is set to on by the CPU 301 in a step S2006, referred to hereinafter, when the count P of the page counter becomes equal to or larger than the threshold value X.

If the CPU 301 refers to the storage area 2704 of the NVMEM 302 in the step S2002 and determines that the cleaning flag is off (NO to the step S2002), the CPU 301 proceeds to a step S2003. In the step S2003, the CPU 301 performs printing of one page of image data generated from a print job received from the PC 102. Note that the CPU 301 and the image processing section 314 generates the image data from the print job in a printing process which is executed in combination with the automatic cleaning process shown in FIGS. 15 to 17.

When printing of one page in the step S2003 is completed, the printed sheet is discharged by the discharge roller 754. In a step S2004, the CPU 301 increments the count P of the page counter stored in the storage area 2701 by 1.

Then, in a step S2005, the CPU 301 performs comparison between the count P of the page counter and the threshold value X (first predetermined sheet count) stored in the storage area 2702 within the NVMEM 302 to determine whether or not the count P of the page counter is equal to or larger than the threshold value X (i.e. whether or not a first condition is satisfied). If the CPU 301 determines in the step S2005 that the count P of the page counter is smaller than the threshold value X (NO to the step S2005), the CPU 301 proceeds to a step S2008. On the other hand, if it is determined in the step S2005 that the count P of the page counter is not smaller than the threshold value X (YES to the step S2005), the CPU 301 proceeds to the step S2006, wherein the CPU 301 turns on the cleaning flag.

Then, in the step S2007, the CPU 301 causes a warning message, which indicates that the fixing device 751 needs cleaning, to be displayed on the LCD display section 1101 of the console section 306.

In the step S2008, the CPU 301 determines whether or not printing of all pages has been completed. If printing of all the pages has not been completed (NO to the step S2008), the CPU 301 returns to the step S2003 to continue printing of the next and following pages. On the other hand, if printing of all pages has been completed (YES to the step S2008), the present process is terminated.

Although in the present embodiment, determination as to whether or not it is required to execute fixing device cleaning is performed based on the count of printed pages, the determination method is not limited to this. For example, fixing device cleaning may be performed at predetermined time intervals, or whenever an environmental change occurs or whenever replacement of a part associated with the printing apparatus 103 is performed, or according to any suitable method.

Next, a description will be given, with reference to FIGS. 16A and 16B, of a case in the present automatic cleaning process, where the fixing device 751 has entered a state requiring cleaning.

If it is determined, in the step S2002 in FIG. 15 after the start of the printing process, that the cleaning flag is on, the CPU 301 proceeds to a step S2101 in FIG. 16A, wherein the CPU 301 suspends the printing process before executing printing. Thereafter, the CPU 301 proceeds to a step S2102, wherein the CPU 301 causes the LCD display section 1101 of the console section 306 to display a message requesting the user to execute cleaning of the fixing device 751.

Then, in a step S2103, the CPU 301 causes the LCD display section 1101 to display a message notifying the user that there is a possibility of automatic execution of fixing device cleaning after completion of the printing process. Details of display of the message on the LCD display section 1101 of the console section 306 will be described hereinafter with reference to FIG. 18A.

Then, in a step S2104, the CPU 301 determines whether or not the user has issued the print continuation instruction without execution of cleaning of the fixing device 751. If it is determined in the step S2104 that the print continuation instruction has not been received (NO to the step S2104), the CPU 301 proceeds to a step S2203 in FIG. 17, referred to hereinafter. On the other hand, if the print continuation instruction has been received (YES to the step S2104), the CPU 301 proceeds to a step S2105, wherein the CPU 301 stores the sheet size and sheet type of a sheet currently subjected to printing, as sheet information, in the RAM 304.

Then, in a step S2106, the CPU 301 performs printing of one page of image data. When the printing is completed, the CPU 301 proceeds to a step S2107, wherein the CPU 301 increments the count P of the page counter by 1.

Then, in a step S2108, the CPU 301 performs comparison between the count P of the page counter and the threshold value Y (second predetermined sheet count) to determine whether or not the count P of the page counter is equal to or larger than the threshold value Y (i.e. whether or not a second condition is satisfied). If the CPU 301 determines in the step S2108 that the count P of the page counter is smaller than the threshold value Y (NO to the step S2108), the CPU 301 proceeds to a step S2109 to determine whether or not printing of all the pages has been completed. If it is determined that printing of all the pages has not been completed (NO to the step S2109), the CPU 301 returns to the step S2106 to continue printing of the next and following pages. On the other hand, if printing of all the pages has been completed (YES to the step S2109), the CPU 301 proceeds to a step S2110 in FIG. 16B.

In the step S2110 in FIG. 16B, the CPU 301 determines whether or not the sheet size stored in the RAM 304 is suitable for cleaning of the fixing device 751. If it is determined in the step S2110 that the sheet size is suitable for cleaning of the fixing device 751 (YES to the step S2110), the CPU 301 proceeds to a step S2111.

In the step S2111, the CPU 301 determines whether or not the sheet type stored in the RAM 304 is suitable for cleaning of the fixing device 751. If it is determined that the sheet type is suitable for cleaning of the fixing device 751 (YES to the step S2111), the CPU 301 proceeds to a step S2112.

In the step S2112, the CPU 301 causes a cleaning process for cleaning the fixing device 751 to be executed using sheets of the same type as used for printing, i.e. sheets currently contained in the sheet feeder 317. Details of the cleaning process for cleaning the fixing device 751 are as described hereinabove with reference to FIGS. 5 to 7.

When the cleaning process in the step S2112 is terminated, the CPU 301 proceeds to a step S2113, wherein the CPU 301 changes the cleaning flag in the NVMEM 302 from on to off. Further, the CPU 301 clears the count P of the page counter to 0, followed by terminating the present process.

On the other hand, if it is determined in the step S2110 or S2111 that the sheet size or the sheet type is not suitable for cleaning of the fixing device 751, the CPU 301 immediately terminates the present process.

Next, a description will be given, with reference to FIG. 17, of a case in the present automatic cleaning process, where the printing process is disabled from being continued when cleaning of the fixing device 751 is not executed.

If it is determined in the step S2001 or in the step S2108 in FIG. 16A that the count P of the page counter is equal to or larger than the threshold value Y, the CPU 301 proceeds to a step S2201, wherein the CPU 301 suspends the printing process before executing printing.

Then, in a step S2202, the CPU 301 causes the LCD display section 1101 of the console section 306 to display a warning message indicating that the fixing device 751 needs cleaning and the printing process is disabled. At this time, only operation for giving the cleaning execution instruction or a job cancellation instruction is enabled on the console section 306 so as to prevent the user from giving the print continuation instruction. Display on the LCD display section 1101 of the console section 306 will be described in detail hereinafter with reference to FIG. 18B.

Then, in the step S2203, the CPU 301 determines whether or not the cleaning execution instruction for cleaning the fixing device 751 has been received. If the cleaning execution instruction has been received (YES to the step S2203), the CPU 301 proceeds to a step S2204, wherein the CPU 301 causes execution of the cleaning process for cleaning the fixing device 751. Details of the cleaning process for cleaning the fixing device 751 are as described hereinabove with reference to FIGS. 5 to 7.

When the cleaning of the fixing device 751 in the step S2204 is completed, the CPU 301 proceeds to a step S2205, wherein the CPU 301 changes the cleaning flag in the NVMEM 302 from on to off and clears the count P of the page counter to 0.

Then, in a step S2206, the CPU 301 suspends the printing operation before resuming the printing process. Thereafter, the CPU 301 proceeds to a step S2207, wherein the CPU 301 causes the LCD display section 1101 of the console section 306 to display a message requesting the user to confirm whether or not correct sheets for printing have been set. Further, the CPU 301 causes a message to be displayed which prompts the user to replace a sheet currently set in the sheet feeder 317. Furthermore, the CPU 301 causes a message to be displayed which describes how to give an instruction for resuming the printing process. The details of the display on the LCD display section 1101 of the console section 306 are as described with reference to FIG. 11B. At this time, the CPU 301 causes a message to be displayed which requests the user to confirm whether or not sheets for use in the print job have been set in the sheet feed cassette 736. When the size and type of the sheet to be used for a page to be printed next can be recognized, the CPU 301 may display the sheet size and type.

Then, in a step S2208, the CPU 301 determines whether or not the user has issued the print resuming instruction. If it is determined that the user has issued the print resuming instruction (YES to the step S2208), the CPU 301 returns to the step S2003 in FIG. 15 to resume the printing process.

On the other hand, if it is not determined in the step S2203 that the fixing device cleaning execution instruction has not been received, the CPU 301 proceeds to a step S2209, wherein the CPU 301 determines whether or not an instruction for canceling the print job (printing process) suspended in the step S2201 has been received. If the instruction for canceling the print job has not been received (NO to the step S2209), the CPU 301 returns to the step S2202. On the other hand, if the instruction for canceling the print job has been received (YES to the step S2209), the CPU 301 cancels the print job suspended in the step S2201, followed by terminating the present process.

Next, a description will be given, with reference to FIGS. 18A and 18B, of display and instruction operations on the LCD display section 1101 of the console section 306.

Figure 18A:
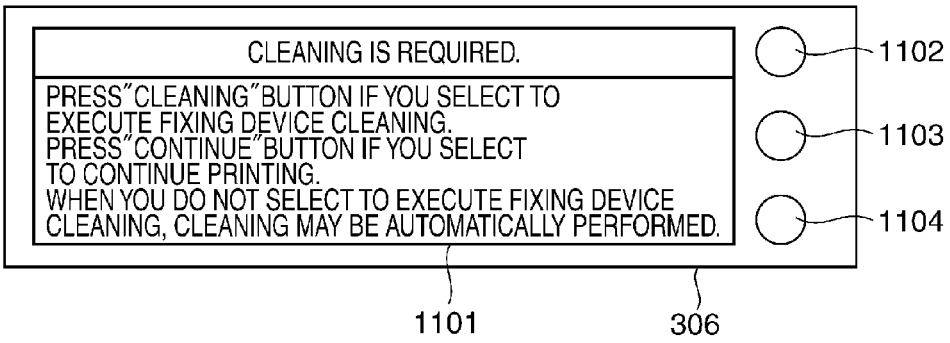

FIG. 18A is a view illustrating an example of an operation screen displayed on the LCD display section 1101 of the console section 306 in the steps S2102 and S2103 in FIG. 16A.

By suspending the printing operation and displaying the above-mentioned messages, it is possible to prompt the user to select whether to execute fixing device cleaning or carry out printing without executing fixing device cleaning. When the user selects to carry out printing without executing fixing device cleaning, the CPU 301 causes the message to be displayed which notifies the user that there is a possibility of automatic execution of fixing device cleaning after completion of the printing process. This makes it possible to notify the user in advance that there is a possibility of fixing device cleaning being automatically performed. If the first operation key 1102 is pressed at this time (step S2203), the CPU 301 proceeds to execution of fixing device cleaning. Alternatively, if the second operation key 1103 is pressed (step S2104), it is possible to continue the suspended printing without carrying out fixing device cleaning operation. Note that, before execution of fixing device cleaning, the CPU 301 causes a message to be displayed which prompts the user to confirm whether or not a sheet suitable for cleaning, described with reference to FIG. 5 or 7, has been set in the sheet feed cassette 736. Further, the CPU 301 may cause the size and type of the sheet suitable for cleaning to be displayed.

Figure 18B:
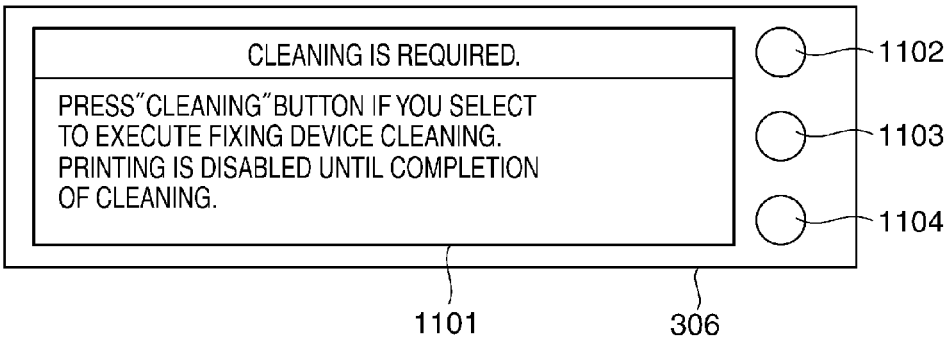

FIG. 18B is a view illustrating an example of an operation screen displayed on the LCD display section 1101 of the console section 306 in the step S2202 in FIG. 17.

By suspending the printing operation and displaying the above-mentioned messages, it is possible to prompt the user to select whether or not to execute fixing device cleaning. Further, by displaying a message notifying the user that printing cannot be continued without execution of fixing device cleaning and performing control such that the printing process is disabled from being continued, it is possible to prevent occurrence of a problem that can be caused due to non-execution of fixing device cleaning. When the first operation key 1102 is pressed at this time, fixing device cleaning is executed. Further, to disable the printing process from being continued, the second operation key 1103 is grayed out to disable depression thereof.

Next, a description will be given, with reference to FIGS. 19A and 19B, of screens displayed on the display section 210 of the PC 102 and guides for operation of giving instructions to the console section 206 which are displayed by application software controlling the printing apparatus 103.

Figure 19A:
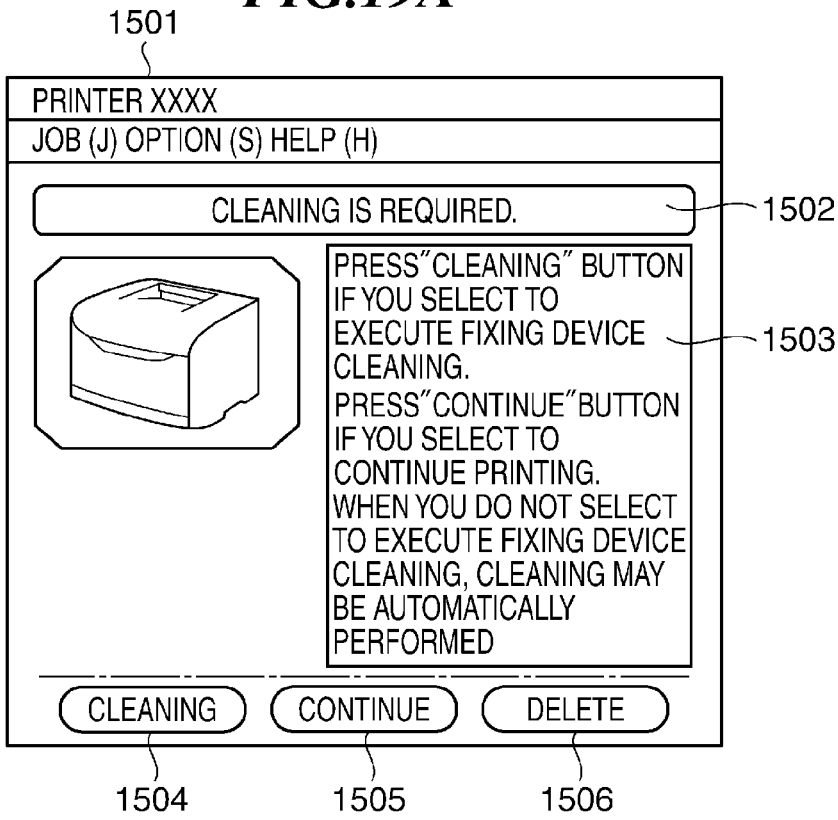

FIG. 19A is a view illustrating an example of a screen of the application software displayed on the display section 210 of the PC 102 in the steps S2102 and S2103 in FIG. 16A.

When the printing process is suspended in the step S2102 or S2103, the messages appearing in FIG. 19A are displayed in the status display section 1502 and the auxiliary message display section 1503, respectively. This can prompt the user to select whether to execute fixing device cleaning or execute printing without execution of fixing device cleaning. Further, the message is displayed which notifies the user that when the printing is continued without executing fixing device cleaning, fixing device cleaning may be executed automatically after completion of the printing. This makes it possible to notify the user in advance that there is a possibility of fixing device cleaning being automatically performed.

When it is determined that the fixing device cleaning execution instruction button 1504 has been pressed, the CPU 201 of the PC 102 instructs the printing apparatus 103 to execute fixing device cleaning. Upon receipt of the cleaning execution instruction from the PC 102, the CPU 301 of the printing apparatus 103 causes the process to proceed from the step S2203 to the step S2204.

Further, when it is determined that the print continuation instruction button 1505 has been pressed, the CPU 201 is enabled to instruct the printing apparatus 103 to continue the suspended printing process without executing fixing device cleaning. Upon receipt of the continuation instruction from the PC 102, the CPU 301 of the printing apparatus 103 causes the process to proceed from the step S2203 to the step S2204.

Figure 19B:
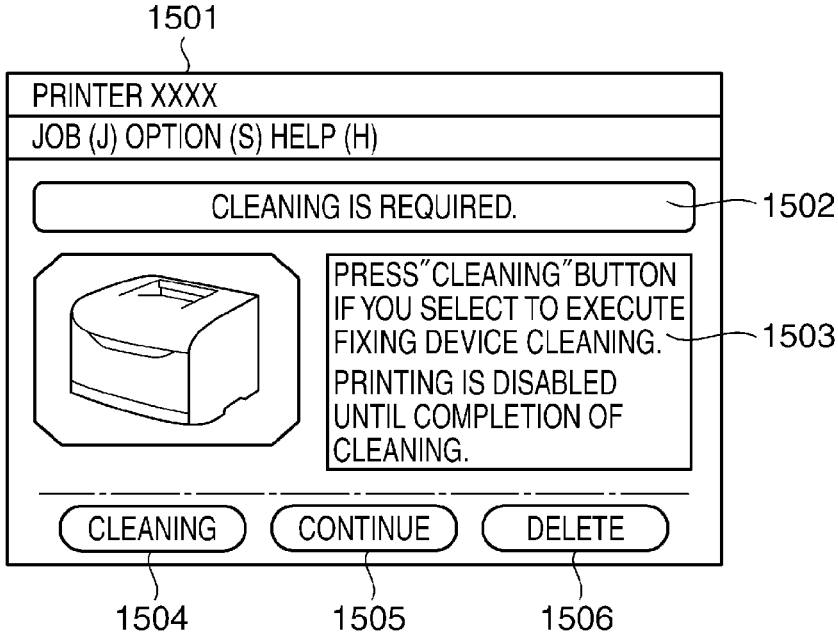

FIG. 19B is a view illustrating an example of a screen of the application software displayed on the display section 210 of the PC 102 in the step S2202 in FIG. 22.

When the printing process is suspended in the step S2202, the messages appearing in FIG. 19B are displayed in the status display section 1502 and the auxiliary message display section 1503, respectively, whereby it is possible to prompt the user to select whether or not to execute fixing device cleaning. Further, by displaying the message which notifies the user that the printing cannot be continued before execution of fixing device cleaning, and by performing control such that the printing cannot be continued, it is possible to prevent occurrence of a problem that can be caused due to non-execution of fixing device cleaning.

When the fixing device cleaning execution instruction button 1504 is pressed, the CPU 201 of the PC 102 instructs the printing apparatus 103 to execute fixing device cleaning. Upon receipt of the fixing device cleaning execution instruction from the PC 102, the CPU 301 of the printing apparatus 103 causes the process to proceed to the step S2204. Further, in response to the instruction from the CPU 301 of the printing apparatus 103, to disable the printing process from being continued, the CPU 201 of the PC 102 causes the print continuation instruction button 1505 to be grayed out to disable depression thereof.

According to the second embodiment, after it is determined that fixing device cleaning is required, when the number of sheets printed in a state where fixing device cleaning is not executed reaches a predetermined sheet count, printing is disabled. This makes it possible to prevent the quality of a printout from being degraded due to continuing printing without executing fixing device cleaning.

In the second embodiment, the first condition is that the number of sheets printed by the printing apparatus 103 has reached the first predetermined sheet count, and the second condition is that the number of sheets printed by the printing apparatus 103 has reached the second predetermined sheet count. However, the first condition and the second condition may be determined based on time periods elapsed after execution of preceding fixing device cleaning. For example, it is possible to set the first condition to 12 hours, and set the second condition to 48 hours which is longer than the first condition.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2011-012240 filed Jan. 24, 2011, which is hereby incorporated by reference herein in its entirety.

What is claimed is:

1. A printing apparatus having a fixing device for fixing an image recorded on a sheet fed from a sheet holding unit, comprising:

a control unit configured to control to feed a sheet from the sheet holding unit and execute cleaning of the fixing device using the fed sheet; and a prompting unit configured to prompt, in accordance with completion of execution of the cleaning of the fixing device by said control unit, a user to set a sheet to be used for printing after execution of the cleaning of the fixing device, in the sheet holding unit.

2. The printing apparatus according to claim 1, wherein after execution of the cleaning of the fixing device by said control unit, said prompting unit prompts the user to set a sheet having a size suitable for printing after execution of the cleaning of the fixing device, in the sheet holding unit.

3. The printing apparatus according to claim 1, wherein after execution of the cleaning of the fixing device by said control unit, said prompting unit prompts a user to set a sheet of a type suitable for printing after execution of the cleaning of the fixing device, in the sheet holding unit.

4. The printing apparatus according to claim 1, wherein before execution of the cleaning of the fixing device by said control unit, said prompting unit prompts a user to set a sheet suitable for executing cleaning, in the sheet holding unit.

5. The printing apparatus according to claim 1, further comprising a count unit configured to count a number of sheets printed by the printing apparatus, and wherein in a case where the number of sheets counted by said count unit reaches a predetermined sheet count, said control unit controls to execute cleaning of the fixing device.

6. The printing apparatus according to claim 1, wherein said control unit causes a printing unit to print an image for cleaning on a sheet fed from the sheet holding unit, and executes cleaning of the fixing device by passing the sheet printed with the image for cleaning, through the fixing device.

7. A printing apparatus having a fixing device for fixing an image recorded based on image data on a sheet fed from a sheet holding unit, comprising:

a control unit configured to control to feed a sheet from the sheet holding unit and execute cleaning of the fixing device using the fed sheet; and a suspension unit configured to control, in accordance with completion of execution of the cleaning of the fixing device by said control unit, such that printing is disabled until a user instruction is received, even if there is image data to be printed.

8. The printing apparatus according to claim 7, further comprising a count unit configured to count a number of sheets printed by the printing apparatus, and wherein in a case where the number of sheets counted by said count unit reaches a predetermined sheet count, said control unit executes cleaning of the fixing device.

9. The printing apparatus according to claim 7, wherein said control unit causes a printing unit to print an image for cleaning on a sheet fed from the sheet holding unit, and executes cleaning of the fixing device by passing the sheet printed with the image for cleaning, through the fixing device.

10. A printing apparatus having a fixing device for fixing an image recorded on a sheet fed from a sheet holding unit, comprising:

a prompting unit configured to prompt a user to execute cleaning of the fixing device, in a case where a number of sheets printed by the printing apparatus has reached a first predetermined sheet count;

a receiving unit configured to receive from the user an instruction as to whether or not to execute the cleaning of the fixing device as a response to the prompt from said prompting unit; and a control unit configured to permit to continue printing without receiving the instruction by the receiving unit until the number of sheets printed by the printing apparatus has reached a second predetermined sheet count which is greater than the first predetermined sheet count and then restrict printing in a case where the number of sheets printed by the printing apparatus has reached the second predetermined sheet count without executing the cleaning.

11. The printing apparatus according to claim 10, further comprising a control unit configured to, in a case where said receiving unit receives an instruction to execute the cleaning, feed a sheet from the sheet holding unit and execute the cleaning of the fixing device using the fed sheet.

12. A method of controlling a printing apparatus having a fixing device for fixing an image recorded on a sheet fed from a sheet holding unit, comprising:

controlling to feed a sheet from the sheet holding unit and execute cleaning of the fixing device using the fed sheet; and prompting, after execution of the cleaning of the fixing device, a user to set a sheet to be used for printing after execution of the cleaning of the fixing device, in the sheet holding unit.

13. A method of controlling a printing apparatus having a fixing device for fixing an image recorded based on image data on a sheet fed from a sheet holding unit, comprising:

controlling to feed a sheet from the sheet holding unit and execute cleaning of the fixing device using the fed sheet; and controlling, after execution of the cleaning of the fixing device, such that printing is disabled until a user instruction is received, even if there is image data to be printed.

14. A method of controlling a printing apparatus having a fixing device for fixing an image recorded on a sheet fed from a sheet holding unit, comprising:

requesting a user to execute cleaning of the fixing device, in a case where a first condition is satisfied;

receiving from the user an instruction as to whether or not to execute the cleaning of the fixing device according to the request; and restricting printing, in a case where an instruction not to execute the cleaning is received from the user and a second condition is satisfied without executing the cleaning.

15. A non-transitory computer-readable storage medium storing a computer-executable program for causing a computer to execute a method of controlling a printing apparatus having a fixing device for fixing an image recorded on a sheet fed from a sheet holding unit, wherein the method comprises:

controlling to feed a sheet from the sheet holding unit and execute cleaning of the fixing device using the fed sheet; and requesting, after execution of the cleaning of the fixing device, a user to set a sheet to be used for printing after execution of the cleaning of the fixing device, in the sheet holding unit.

16. A non-transitory computer-readable storage medium storing a computer-executable program for causing a computer to execute a method of controlling a printing apparatus having a fixing device for fixing an image recorded based on image data on a sheet fed from a sheet holding unit, wherein the method comprises:

controlling to feed a sheet from the sheet holding unit and execute cleaning of the fixing device using the fed sheet; and controlling, after execution of the cleaning of the fixing device, such that printing is disabled until a user instruction is received, even if there is image data to be printed.

17. A non-transitory computer-readable storage medium storing a computer-executable program for causing a computer to execute a method of controlling a printing apparatus having a fixing device for fixing an image recorded on a sheet fed from a sheet holding unit, wherein the method comprises:

prompting a user to execute cleaning of the fixing device, when a first condition is satisfied;

receiving from the user an instruction as to whether or not to execute the cleaning of the fixing device according to the request; and restricting printing, in a case where an instruction not to execute the cleaning is received from the user and a second condition is satisfied without executing the cleaning.

* * * * *